US008948625B2

(12) United States Patent
Hayase et al.

(10) Patent No.: US 8,948,625 B2
(45) Date of Patent: Feb. 3, 2015

(54) IMAGE FORMING APPARATUS FOR DETECTING ABNORMALITY OF A FIXING DEVICE

(71) Applicant: Konica Minolta, Inc., Tokyo (JP)

(72) Inventors: Toru Hayase, Toyohashi (JP); Naoki Yamamoto, Toyohashi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/659,441

(22) Filed: Oct. 24, 2012

(65) Prior Publication Data

US 2013/0108287 A1 May 2, 2013

(30) Foreign Application Priority Data

Oct. 27, 2011 (JP) ..... 2011-236032

(51) Int. Cl.
*G03G 15/20* (2006.01)

(52) U.S. Cl.
USPC ..... 399/33; 399/67

(58) Field of Classification Search
USPC ..... 399/33, 69
See application file for complete search history.

(56) References Cited

U.S. PATENT DOCUMENTS

| | | | | |
|---|---|---|---|---|
| 2008/0240748 | A1* | 10/2008 | Kinouchi et al. | 399/33 |
| 2008/0279577 | A1* | 11/2008 | Ito | 399/69 |
| 2011/0222876 | A1* | 9/2011 | Yuasa et al. | 399/33 |

FOREIGN PATENT DOCUMENTS

| | | | | |
|---|---|---|---|---|
| JP | 08-211780 | | 8/1996 | |
| JP | 2000-227732 | | 8/2000 | |
| JP | 2001-075415 | | 3/2001 | |
| JP | 2008-009330 | | 1/2008 | |
| JP | 2009075375 A | * | 4/2009 | G03G 15/20 |
| JP | 2009-109997 | | 5/2009 | |

OTHER PUBLICATIONS

English machine translation of JPA_2009-075375.*

* cited by examiner

*Primary Examiner* — Walter L Lindsay, Jr.
*Assistant Examiner* — Arlene Heredia Ocasio
(74) *Attorney, Agent, or Firm* — Lucas & Mercanti, LLP

(57) ABSTRACT

Image forming apparatus including: fixing device thermally fixing unfixed image on recording sheet by causing recording sheet to pass through nip formed by pressing member pressing against outer circumferential surface of heating rotating body having resistance heating layer; temperature measuring unit measuring temperatures of resistance heating layer in measurement regions set by sectioning outer circumferential surface of heating rotating body along rotational axis; information obtaining unit obtaining information indicating temperature changes in measurement regions in one rotational period of heating rotating body, by sampling measured temperatures; and abnormality judging unit judging whether abnormality has occurred in resistance heating layer based on result of comparison of information that is made between measurement regions in each combination, wherein one or more combinations of measurement regions have been set for each of paper-passing and non-paper-passing regions in nip by using all measurement regions in each of paper-passing and non-paper-passing regions.

12 Claims, 12 Drawing Sheets

FIG. 10

【Center-based transportation】

CL

| First temperature sensor | | | | | | | | Second temperature sensor | | | | | | | |
|---|---|---|---|---|---|---|---|---|---|---|---|---|---|---|---|
| PxA8 | PxA7 | PxA6 | PxA5 | PxA4 | PxA3 | PxA2 | PxA1 | PxB1 | PxB2 | PxB3 | PxB4 | PxB5 | PxB6 | PxB7 | PxB8 |
| PxB8 | PxB7 | PxB6 | PxB5 | PxB4 | PxB3 | PxB1 | PxB2 | PxA2 | PxA1 | PxA3 | PxA4 | PxA5 | PxA6 | PxA7 | PxA8 |

FIG. 13

【One-sided transportation】

Pix

| | | First temperature sensor | | | | | | | | Second temperature sensor | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| 1 | (90) <d≦104 | 12～16 | 4 | 5 | 2 | 3 | 11 | 9 | 10 | 7 | 8 | 6 | 1 | 1 | 1 | 1 | 1 |
| 2 | 104<d≦126 | 11, 12～16 | 4 | 5 | 2, 6 | 3 | 4 | 9 | 10 | 7 | 8 | 1 | 1 | 1 | 1 | 1 | 1 |
| 3 | 126<d≦152 | 9, 11～16 | 4 | 5 | 2, 6 | 3, 7 | 4 | 5 | 10 | 1 | 8 | 1 | 1 | 1 | 1 | 1 | 1 |
| 4 | 152<d≦178 | 9～16 | 4 | 5 | 2 | 3, 7 | 8 | 5 | 6 | 1 | 1 | 1 | 1 | 1 | 1 | 1 | 1 |
| 5 | 178<d≦204 | 10～16 | 4 | 5 | 2 | 3 | 8 | 9 | 6 | 7 | 1 | 1 | 1 | 1 | 1 | 1 | 1 |
| 6 | 204<d≦226 | 11～16 | 4 | 5 | 2, 6 | 3 | 4 | 9 | 10 | 7 | 8 | 1 | 1 | 1 | 1 | 1 | 1 |
| 7 | 226<d≦247 | 12～16 | 4 | 5 | 2 | 3 | 11 | 9 | 10 | 7 | 8 | 6 | 1 | 1 | 1 | 1 | 1 |
| 8 | 247<d≦267 | 13～16 | 4 | 5 | 2 | 3, 12 | 11 | 9 | 10 | 7 | 8 | 6 | 5 | 1 | 1 | 1 | 1 |
| 9 | 267<d≦287 | 14～16 | 4 | 5 | 2, 13 | 3, 12 | 11 | 9 | 10 | 7 | 8 | 6 | 5 | 4 | 1 | 1 | 1 |
| 10 | 287<d≦309 | 15, 16 | 4 | 14 | 2, 13 | 12 | 11 | 9 | 10 | 7 | 8 | 6 | 5 | 4 | 3 | 1 | 1 |
| 11 | 309<d≦330 | 16 | 15 | 14 | 13 | 12 | 11 | 9 | 10 | 7 | 8 | 6 | 5 | 4 | 3 | 2 | 1 |

Paper-passing range

IMAGE FORMING APPARATUS FOR DETECTING ABNORMALITY OF A FIXING DEVICE

This application is based on application No. 2011-236032 filed in Japan, the contents of which are hereby incorporated by reference.

BACKGROUND OF THE INVENTION (1) Field of the Invention

The present invention relates to an image forming apparatus including a fixing device for fixing an unfixed image formed on a recording sheet onto the recording sheet by heat.

(2) Description of the Related Art

In image forming apparatuses such as printers or copiers adopting the electrophotographic method, typically a toner image corresponding to a piece of image data is transferred onto a recording sheet such as a recording paper sheet or an OHP sheet, and the unfixed toner image is then fixed onto the recording sheet by a fixing device. The fixing device heats the toner image on the recording sheet so that the toner image melts and is fixed on the recording sheet.

In recent years, a resistance heating method is adopted for a heater provided in the fixing device, wherein the resistance heating method uses a resistance heating body that emits heat when the current flows through it. Japanese Patent Application Publication No. 2009-109997 discloses a fixing device using heating belt (heat-emitting belt) that includes a resistance heating body. In this fixing device, an elastic roll is provided within the range of circulating movement of the heating belt that includes the resistance heating body. With this structure, the heating belt sandwiched by the elastic roll and a pressing roller makes a circulating movement. Also, a fixing nip, through which the recording sheet passes, is formed between the heating belt and the pressing roller.

An alternating current is supplied to both ends of the resistance heating body provided in the heating belt, wherein the two ends are positioned along the width direction perpendicular to the circulating movement direction of the heating belt (along the rotational axis direction of the heating belt, namely, along a direction perpendicular to the transportation direction of the recording sheet). The resistance heating layer emits Joule heat when an electric current is supplied thereto. The heat emitted by the resistance heating layer is applied to the recording sheet passing through the fixing nip. This allows the toner image on the recording sheet to be fixed thereon by the heat.

In this fixing device, the heating belt itself, on which the recording sheet is transported, emits heat, thus the distance from the resistance heating layer, which is the source of the heat, to the recording sheet is short. Accordingly, this structure enables the resistance heating layer to apply heat to the recording sheet efficiently, and the amount of energy consumption to be restricted during the warm-up and the fixing operation. The structure also shortens the warm-up time since the heating belt as the heat source has a small thermal capacity.

A fixing device using a resistance heating layer may have a damage such as a scratch in the resistance heating layer provided in the heating belt when, for example, a paper jam is inappropriately handled, or a foreign material is stuck on the recording sheet. If a long scratch occurs in the resistance heating layer and the scratch intersects with a direction in which the electric current flows in the resistance heating layer (with the width direction of the heating belt), the vicinities of both ends of the scratch have high temperatures locally.

The reason is as follows. When the resistance heating layer has a scratch extending along the circumferential direction, the current cannot cross the scratch to flow in the width direction of the heating belt, but flows bypassing the scratch. In that case, the electric current converges at the vicinities of both ends of the scratch, causing overheat at the both ends, and a local high-temperature state is produced.

When the heating belt is in such a local high-temperature state, image noise such as a high-temperature offset may occur. Also, when the scratch is further long, the current density at the vicinities of both ends of the scratch further increases, and an abnormal high-temperature state may be produced. In that case, the fixing device may be seriously damaged. For example, the surface of the pressing roller pressed against the heating belt may melt. For this reason, if a damage such as a scratch occurs in the resistance heating layer of the heating belt, it is preferable that the damage is detected soon to prevent occurrence of image noise, a damage of the pressing roller and the like.

When a scratch occurs in the resistance heating layer of the heating belt, the temperature in the vicinities of both ends of the scratch increases to create a local high-temperature region. As a result, it is possible to judge whether or not a scratch or the like has occurred in the resistance heating layer by detecting whether or not the heating belt has a local high-temperature region.

Japanese Patent Application Publication No. 2000-227732 discloses a structure where an infrared sensor is used to detect a surface temperature of a heating rotating body such as a heating belt. According to the disclosure of this document, the infrared sensor is disposed to face the surface of the heating rotating body in the state where the infrared sensor can move along the axial direction, and detects the surface temperature of the measurement region facing the surface of the heating rotating body in the rotating state.

By using the infrared sensor described in Japanese Patent Application Publication No. 2000-227732, it is possible to detect a temperature (average temperature or the like) while the heating belt rotates once (in one rotational period) in the measurement region, which is a partial region along the width direction of the heating belt, during the image formation (fixing operation). Accordingly, if it is possible to detect whether or not a temperature measured at the measurement region in the heating belt in one rotational period is higher than a predetermined threshold temperature, it is possible to detect whether or not a scratch has occurred in a part of the resistance heating layer corresponding to the measurement region. Here, if the measurement region of the infrared sensor is set over the whole region of the heating belt in the width direction, it would become possible to make the judgment on the occurrence of a scratch over the whole region of the resistance heating layer.

However, when the measurement region is set over the whole region in the width direction, an erroneous judgment is likely to occur. That is to say, when the recording sheet passes through the fixing nip, heat is removed from the heating belt by the recording sheet in the paper-passing region, but is not removed in the non-paper-passing region. Thus the surface temperature of the heating belt is higher in the non-paper-passing region than in the paper-passing region. Accordingly, when the recording sheet passes through the fixing nip, the temperature is measured to be higher in the non-paper-passing region than in the paper-passing region, and it may be erroneously judged that a scratch has occurred in the non-paper-passing region.

One conceivable measure for preventing the problem would be to set different thresholds for the paper-passing region and the non-paper-passing region. However, even if such a measure is taken, the temperatures of the heating belt measured in each rotational period may vary due to uneven thickness of the resistance heating layer in the circumferential direction, and it may be erroneously judged that a scratch has occurred in the resistance heating layer.

Also, when the fixing operation is continuously executed for a plurality of recording sheets, the plurality of recording sheets pass through the fixing nip with a predetermined gap therebetween. In that case, heat is not removed from the heating belt in the paper-passing region during a period of the predetermined gap between two recording sheets passing through the fixing nip. If such a state occurs while the temperature of the heating belt is measured in one rotational period, the temperature measured by the infrared sensor becomes high.

In that case, the temperature measured in the paper-passing region may exceed a set threshold temperature, and it may be erroneously judged that a scratch has occurred in the paper-passing region although in the actuality no scratch has occurred in the paper-passing region.

The present invention has been conceived in light of the above problems, and it is an object thereof to provide an image forming apparatus that accurately and unerringly judges whether or not an abnormality such as a scratch has occurred in the resistance heating layer.

SUMMARY OF THE INVENTION

The above object is fulfilled by an image forming apparatus comprising: a fixing device configured to thermally fix an unfixed image on a recording sheet by causing the recording sheet with the unfixed image formed thereon to pass through a nip formed by a pressing member pressing against an outer circumferential surface of a heating rotating body that has a resistance heating layer; a temperature measuring unit configured to measure temperatures of the resistance heating layer in a plurality of measurement regions that are set by sectioning the outer circumferential surface of the heating rotating body along a rotational axis direction of the heating rotating body; an information obtaining unit configured to obtain information indicating temperature changes in the measurement regions in one rotational period of the heating rotating body, by sampling the temperatures measured by the temperature measuring unit during rotation of the heating rotating body; and an abnormality judging unit configured to judge whether or not an abnormality has occurred in the resistance heating layer in accordance with a result of comparison of the information obtained by the information obtaining unit, the comparison being made between measurement regions in each combination of measurement regions in a state where one or more combinations of measurement regions have been set by using all measurement regions of a paper-passing region in the nip and one or more combinations of measurement regions have been set by using all measurement regions of a non-paper-passing region in the nip.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6 part (b) is a graph showing the change in surface temperature of the heating belt in the vicinities of the scratch illustrated in FIG. 6 part (a);

FIG. 10 is a table indicating the combinations of the measurement regions illustrated in FIG. 9;

FIG. 13 is a table showing the combinations of measurement regions illustrated in FIG. 12.

DESCRIPTION OF EMBODIMENTS

The following describes embodiments of an image forming apparatus of the present invention.

[Embodiment 1]

<Structure of Image Forming Apparatus>

Figure 1:
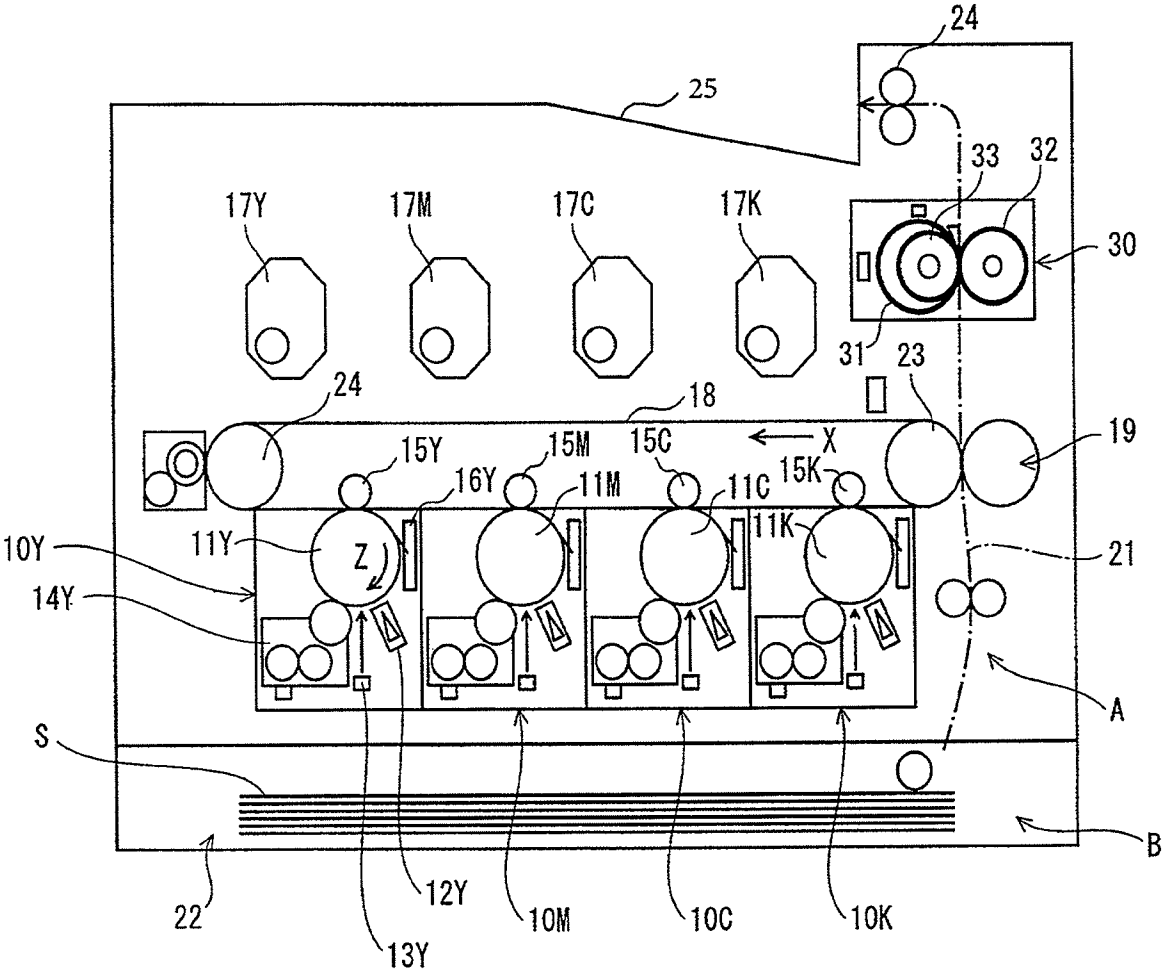
FIG. 1 is a schematic view illustrating the structure of a tandem-type color printer which is an example of the image forming apparatus in an embodiment of the present invention.

FIG. 1 is a schematic view illustrating the structure of a tandem-type color printer (hereinafter merely referred to as a "printer"), which is an example of the image forming apparatus in an embodiment of the present invention. This color printer forms a full-color or monochrome image onto a recording sheet such as a recording paper sheet or an OHP sheet by a known electrophotographic method based on image data or the like input from an external terminal device or the like via a network (for example, LAN).

The printer includes an image forming section A and a paper feed section B which is located below the image forming section A, wherein the image forming section A forms a toner image with toners of colors yellow (Y), magenta (M), cyan (C), and black (K) onto a recording sheet. The paper feed section B includes a paper feed cassette 22 storing inside therein recording sheets S, and the recording sheets S stored in the paper feed cassette 22 are fed to the image forming section A.

The image forming section A includes an intermediate transfer belt 18 which is provided at an approximate center of the printer. The intermediate transfer belt 18 is wound around a pair of belt circulating rollers 23 and 24 which are arranged with a horizontal distance therebetween so that the belt can make a circulating movement around the belt circulating rollers. The intermediate transfer belt 18 is driven by a motor (not illustrated) and makes a circulating movement, moving in the direction indicated by the arrow "X".

Process units 10Y, 10M, 10C, and 10K are provided below the intermediate transfer belt 18. Process units 10Y, 10M, 10C, and 10K are disposed in the stated order in the direction in which the intermediate transfer belt 18 moves in a circulating motion, and form toner images with toners of colors yellow (Y), magenta (M), cyan (C), and black (K) onto the intermediate transfer belt 18, respectively. Each of the process units 10Y, 10M, 10C, and 10K is attachable and detachable to/from the image forming section A.

Above the intermediate transfer belt 18, toner containers 17Y, 17M, 17C, and 17K are disposed to face the process units 10Y, 10M, 10C, and 10K respectively via the intermediate transfer belt 18. The toner containers 17Y, 17M, 17C, and 17K respectively contain toners of colors yellow (Y), magenta (M), cyan (C), and black (K), which are supplied to the process units 10Y, 10M, 10C, and 10K, respectively.

The process units 10Y, 10M, 10C, and 10K respectively include photosensitive drums 11Y, 11M, 11C, and 11K which are disposed under the intermediate transfer belt 18 to be able to rotate facing the intermediate transfer belt 18. The process units 10Y, 10M, 10C, and 10K form toner images with toners of colors Y, M, C, and K respectively supplied from the toner containers 17Y, 17M, 17C, and 17K, onto the photosensitive drums 11Y, 11M, 11C, and 11K, respectively.

The process units 10Y, 10M, 10C, and 10K have approximately the same structure except that they use toners of different colors. Thus in the following, only the structure of the process unit 10Y is explained, and description of the structures of the other process units 10M, 10C, and 10K is omitted.

The photosensitive drum 11Y provided in the process unit 10Y can rotate in the direction indicated by the arrow "Z". Also, the process unit 10Y includes a charger 12Y which is disposed below the photosensitive drum 11Y and electrically charges the surface of the photosensitive drum 11Y evenly. The charger 12Y is disposed to face the photosensitive drum 11Y.

The process unit 10Y further includes an exposure device 13Y and a developing part 14Y. The exposure device 13Y is disposed in the downstream of the charger 12Y in the rotation direction of the photosensitive drum 11Y, below the photosensitive drum 11Y in the vertical direction. The developing part 14Y is disposed in the downstream of an exposure position of the exposure performed by the exposure device 13Y, on the surface of the photosensitive drum 11Y in the rotation direction of the photosensitive drum 11Y.

The exposure device 13Y radiates a laser beam onto the surface of the photosensitive drum 11Y, which has been electrically charged by the charger 12Y evenly, to form an electrostatic latent image thereon. The developing part 14Y develops the electrostatic latent image formed on the surface of the photosensitive drum 11Y, with use of the toner of color Y.

Above the process unit 10Y, a first transfer roller 15Y is disposed to face the photosensitive drum 11Y via the intermediate transfer belt 18. The first transfer roller 15Y is attached to the image forming section A. Upon receiving application of a transfer bias voltage, the first transfer roller 15Y forms an electric field between the roller itself and the photosensitive drum 11Y.

Note that first transfer rollers 15M, 15C, and 15K are disposed as well above the process units 10M, 10C, and 10K to face the photosensitive drums 11M, 11C, and 11K via the intermediate transfer belt 18, respectively.

The toner images formed on the photosensitive drums 11Y, 11M, 11C, and 11K are transferred onto the intermediate transfer belt 18 as the first transfer, by the action of the electric fields formed between the first transfer rollers 15Y, 15M, 15C, and 15K and the photosensitive drums 11Y, 11M, 11C, and 11K, respectively. After the transfer of the toner image, the photosensitive drum 11Y is cleaned by a cleaner 16Y.

Note that, when a full-color image is to be formed, the timings at which the process units 10Y, 10M, 10C, and 10K form the respective images are adjusted so that, by the multi-transfer, the toner images are transferred from the photosensitive drums 11Y, 11M, 11C, and 11K to the same area on the surface of the intermediate transfer belt 18.

On the other hand, when a monochrome image is to be formed, only a selected process unit (for example, the process unit 10K that uses the toner of color K) is driven so that a toner image is formed on the photosensitive drum corresponding to the process unit (for example, the photosensitive drum 11K) and transferred therefrom to a predetermined area on the surface of intermediate transfer belt 18 by a first transfer roller disposed to face the process unit (for example, the first transfer roller 15K).

With the circulating movement of the intermediate transfer belt 18, a portion of the intermediate transfer belt 18 on which the toner images have been transferred moves to an end of the belt at which the belt is wound around the belt circulating roller 23 (in FIG. 1, the end on the right-hand side).

A second transfer roller 19 is provided to face the belt circulating roller 23 with the intermediate transfer belt 18 therebetween. Note that a sheet transportation path 21 passes between the second transfer roller 19 and the intermediate transfer belt 18 at the belt tensioning roller 23. The second transfer roller 19 is pressed against the intermediate transfer belt 18 so that a transfer nip is formed therebetween. A transfer bias voltage is applied to the second transfer roller 19, and when a transfer bias voltage is applied to the second transfer roller 19, an electric field is formed between the second transfer roller 19 and the intermediate transfer belt 18.

A recording sheet S is fed onto the sheet transportation path 21 from the paper feed cassette 22 of the paper feed section B, and transported to the transfer nip formed by the second transfer roller 19 and the intermediate transfer belt 18. By the action of the electric field formed between the second transfer roller 19 and the 20 intermediate transfer belt 18, the toner image, having been transferred onto the intermediate transfer belt 18, is transferred therefrom onto the recording sheet S in the transfer nip, the transfer being referred to as a second transfer.

The recording sheet S having passed through the transfer nip is transported to the fixing device 30 placed above the second transfer roller 19. In the fixing device 30, the unfixed toner image on the recording sheet S is heated and pressed to be fixed on the recording sheet S. The recording sheet S with the toner image fixed thereon is ejected by a paper-eject roller 24 onto a paper tray 25.

Note that, in the printer of the present embodiment, each recording sheet S housed in the paper feed cassette 22 is transported to the transfer nip in such a manner that the center of the recording sheet S in the width direction perpendicular to the transportation direction moves along substantially the center of the width of the sheet transportation path 21 (hereinafter, the above manner in which the recording sheet S is transported is referred to as "center-based"). Accordingly, the recording sheet S passes through the transfer nip by the center-based transportation and is transported to the fixing device 30. Thus, also in the fixing device 30, the recording sheet S is transported in the state where the center of the recording sheet S in the width direction substantially matches the center of the width of the sheet transportation path.

<Structure of Fixing Device>

Figure 2:
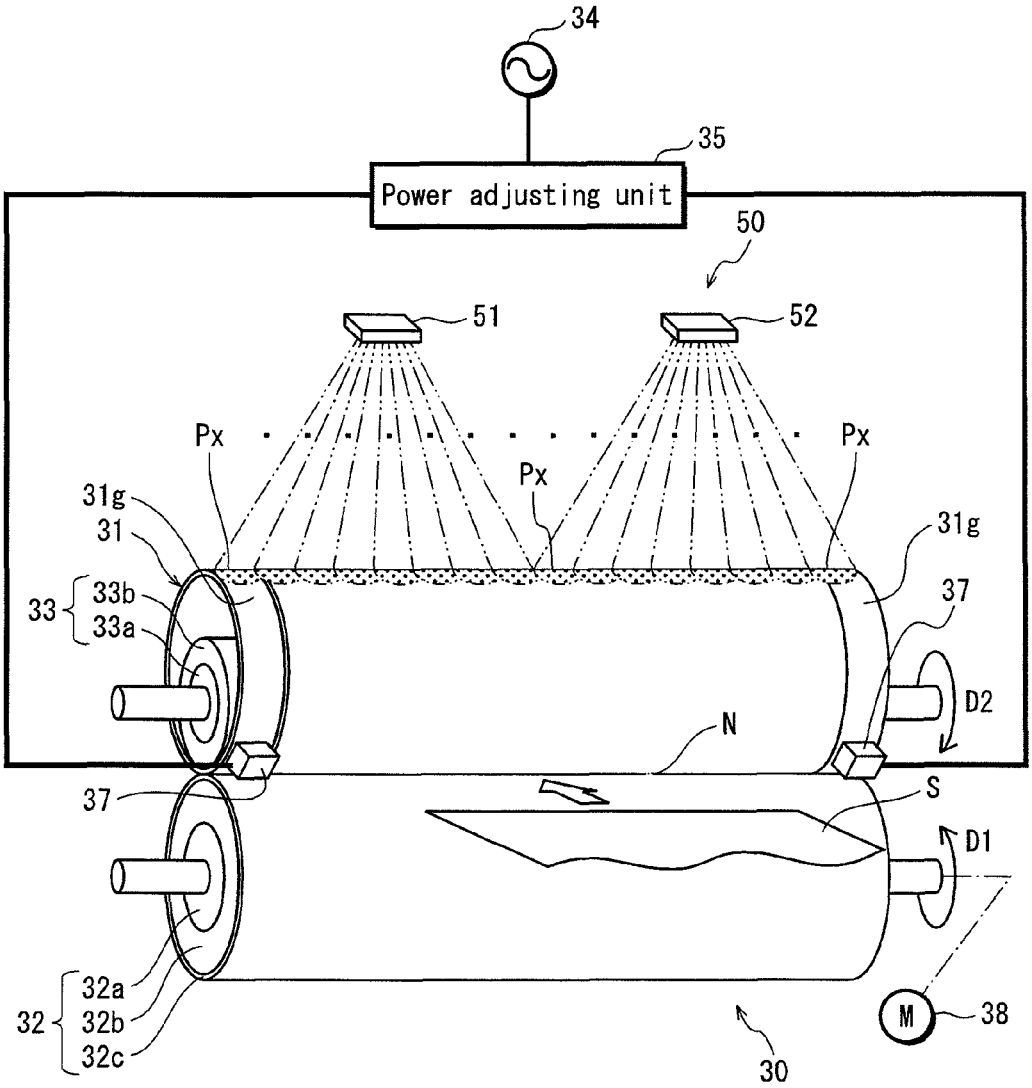
FIG. 2 is a schematic perspective view illustrating the structure of the main parts of a fixing device provided in the printer illustrated in FIG. 1.
Figure 3:
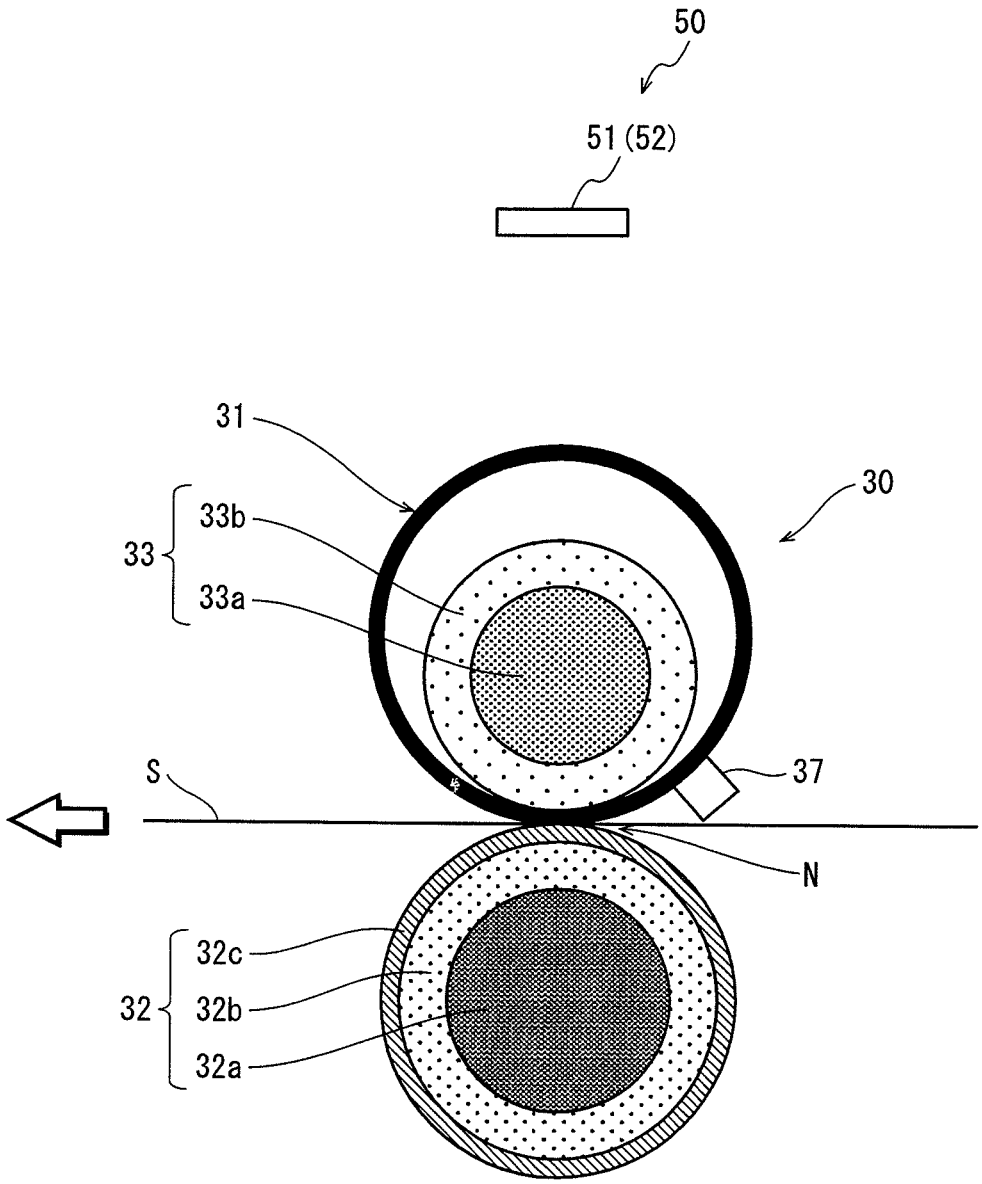
FIG. 3 is a schematic cross-sectional view of the main parts of the fixing device illustrated in FIG. 2.

FIG. 2 is a schematic perspective view illustrating the structure of the main parts of the fixing device 30. FIG. 3 is a schematic cross-sectional view of the main parts illustrated in FIG. 2. Note that, in the actual fixing device 30, the recording sheet passes through the fixing nip in the vertically upward direction, as illustrated in FIG. 1, while FIG. 2 illustrates the fixing device 30 in which the recording sheet passes from the front side to the back side of the sheet plane, and FIG. 3 illustrates the fixing device 30 in which the recording sheet passes from the right-hand side to the left-hand side of the sheet plane.

As illustrated in FIGS. 2 and 3, the fixing device 30 includes a pressing roller 32, a heating belt 31 and a fixing roller 33, wherein the pressing roller 32 is a member for giving a pressure, the heating belt 31 is provided in a state in which it rotates (makes a circulating movement) while its outer circumferential surface is pressed by the pressing roller 32, and the fixing roller 33 is provided within the range of rotation (range of circulating movement) of the heating belt 31 to be pressed against the inner circumferential surface of the heating belt 31.

The heating belt 31 includes a resistance heating layer 31*b* (see FIG. 4) that emits heat when an electric current is passed through it. The heating belt 31 is heated when the resistance heating layer 31*b* emits heat, and makes a circulating movement (rotates) while it is heated. Accordingly, the heating belt 31 constitutes a heating rotating body.

The heating belt 31, as one example, is in the shape of a cylinder, wherein the length thereof along the rotational axial direction (width direction) perpendicular to the circulating movement direction is slightly greater than the length of the circumferential surface of the pressing roller 32 along the axial direction, and the diameter thereof is slightly greater than the diameter of the pressing roller 32. The heating belt 31 and the pressing roller 32 are provided such that the rotational axes thereof are parallel and the outer circumferential surface of the heating belt 31 and the outer circumferential surface of the pressing roller 32 are pressed against each other.

A fixing nip N, through which the recording sheet S passes, is formed between the heating belt 31 and the pressing roller 32 when they are in the state of pressing against each other.

In the present embodiment, when the recording sheet S is transported center-based in the transportation path, the center of the recording sheet S in the width direction perpendicular to the transportation direction of the recording sheet S substantially matches the center of the fixing nip N in the rotational axial direction when the recording sheet S passes through the fixing nip N.

Figure 4:
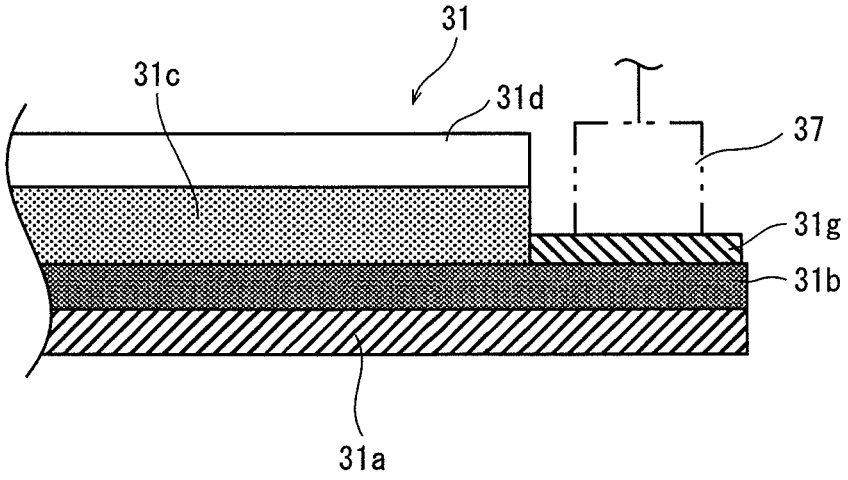
FIG. 4 is a transverse cross-sectional view of one end of a heating belt provided in the fixing device illustrated in FIG. 2, the end being located along the width direction (the axial direction) perpendicular to the circulating movement direction.

FIG. 4 is a transverse cross-sectional view of one end of the heating belt 31, the end being located along the axial direction perpendicular to the circulating movement direction. The heating belt includes a reinforcement layer 31*a* and a resistance heating layer 31*b*. The reinforcement layer 31*a* is formed from, for example, polyimide (PI) in the shape of a cylinder having a constant thickness. The resistance heating layer 31*b* is laminated on the circumferential surface of the reinforcement layer 31*a* over the whole circumference thereof. The resistance heating layer 31*b* is made of a resistance heating material that emits Joule heat when an electric current is passed through it.

Two electrode parts 31*g* are formed on the circumferential surface of the resistance heating layer 31*b* at two ends thereof in the axial direction over the whole circumference thereof, respectively, wherein the electrode parts 31*g* are made of an electrically conductive material. Each of the electrode parts 31*g* is formed to be located outside the fixing nip N in the axial direction.

Two electricity supplying members 37 are provided, in an electrically conductive state, on the circumferential surfaces of the electrode parts 31*g* in such a manner that the electricity supplying members 37 and the electrode parts 31*g* press against each other. The electricity supplying members 37 are located more on the upstream side in the rotational direction of the heating belt 31 than the fixing nip N, and are in sliding contact with the circumferential surfaces of the electrode parts 31*g* at positions near the fixing nip N.

An elastic layer 31*c* is laminated on a part of the circumferential surface of the resistance heating layer 31*b*, the part being sandwiched by the two electrode parts 31*g*, and a releasing layer 31*d* is laminated on the circumferential surface of the elastic layer 31*c*.

As illustrated in FIG. 2, each of the electricity supplying members 37 receives supply of a predetermined amount of electric power from a power adjusting unit 35 via a harness, wherein the power adjusting unit 35 receives an alternating current from a commercial alternating-current power source 34, adjusts the received alternating current to the predetermined amount of electric power, and supplies the predetermined amount of electric power to the electricity supplying members 37.

Each of the electricity supplying members 37 is, for example, an electrically conductive brush which is formed by baking a mixture of powders of carbon, copper and the like. The electricity supplying members 37 are in sliding contact with the circumferential surfaces of the electrode parts 31*g* when the heating belt 31 rotates in the state where the electricity supplying members 37 and the electrode parts 31*g* are pressed against each other. This maintains the electrically conductive state between the electricity supplying members 37 and the electrode parts 31*g* that are pressed against each other.

Note that the electricity supplying members 37 are not limited to the electrically conductive brush, but may be any other structure than the electrically conductive brush in so far as the structure maintains the electrically conductive state between the electricity supplying members 37 and the electrode parts 31*g* that are in sliding contact with each other. For example, each of the electricity supplying members 37 may be an electrically conductive member made of a metal, or may be an insulating member whose surface is plated with Cu, Ni, or the like. Furthermore, each of the electricity supplying members 37 may be a rotating member, such as a roller, that rotates while being in contact with a corresponding one of the electrode parts 31*g* that makes a circulating movement.

A temperature detecting unit 50 is provided to face a position of the circumferential surface of the heating belt 31, the position being at 180 degrees to a position of the circumferential surface of the heating belt 31 where it is pressed by the pressing roller 32. The temperature detecting unit 50 measures the temperature of the circumferential surface of the heating belt 31. The temperature detecting unit 50 is, for example, provided with a first temperature sensor 51 and a second temperature sensor 52 such that it can measure the temperature of the circumferential surface of the heating belt 31 it faces, over the whole region of the circumferential surface in the rotational axial direction.

The first temperature sensor 51 and the second temperature sensor 52 are each a multi-array thermopile composed of a plurality of (in the present embodiment, eight) thermopiles arrayed in series along the width direction of the heating belt 31. The first temperature sensor 51 is deposited so that the measurement thereof ranges from the center to one end of the heating belt 31 in the width direction of the heating belt 31, and the second temperature sensor 52 is deposited so that the measurement thereof ranges from the center to the other end of the heating belt 31 in the width direction of the heating belt 31.

Each of the thermopiles of the first temperature sensor 51 and the second temperature sensor 52 is set to measure the temperature of a constant area of a region (measurement region) Px that is one of a plurality of serial regions in the width direction constituting the heating belt 31.

Each of the first temperature sensor 51 and the second temperature sensor 52 is deposited at a predetermined distance from the surface of the heating belt 31 such that the regions Px to be measured by the eight thermopiles align without space therebetween over the whole region in the width direction of the circumferential surface of the heating belt 31, and the regions Px are substantially equal in area. Each of the thermopiles of the first temperature sensor 51 and the second temperature sensor 52 measures an average temperature of a corresponding measurement region having the constant area on the circumferential surface of the heating belt 31. The surface temperatures of the heating belt 31 measured by the first temperature sensor 51 and the second temperature sensor 52 are used to detect whether or not any abnormality such as a scratch has occurred in the heating belt 31, or to control the surface temperature of the heating belt 31 to a predetermined value.

Each of the first temperature sensor 51 and the second temperature sensor 52 needs to be deposited such that the measurement regions Px of the thermopiles align continuously over the whole region of the heating belt 31 in the width direction such that if an abnormality such as a scratch has occurred in the resistance heating layer 31*b* of the heating belt 31, the abnormality can be detected regardless of the position where the abnormality has occurred. In that case, ends of adjacent measurement regions Px may overlap with each other, or may be in contact with each other without overlapping.

Note that in the present embodiment, eight measurement regions Px of the heating belt 31 to be measured by the eight thermopiles of the first temperature sensor 51 are called first to eighth measurement regions PxA1 to PxA8 in order from the center to one end of the heating belt 31 in the width direction thereof. Also, eight measurement regions Px of the heating belt 31 to be measured by the eight thermopiles of the second temperature sensor 52 are called first to eighth measurement regions PxB1 to PxB8 in order from the center to the other end of the heating belt 31 in the width direction thereof.

Note that the temperature detecting unit 50 does not need to include two temperature sensors such as the first temperature sensor 51 and the second temperature sensor 52, but may include one temperature sensor that detects the surface temperature of the heating belt 31 over the whole region in the width direction thereof. In that case, the temperature sensor may be composed of one multi-array thermopile, or an array of a plurality of thermopiles. In either case, a plurality of measurement regions Px are set on the heating belt 31 along the width direction of the heating belt 31.

Note that the number of measurement regions Px set on the heating belt 31 along the width direction of the heating belt 31 is not limited in particular, but may be set appropriately based on: the length of the heating belt 31 in the width direction; the area of each measurement region; the required measurement accuracy and the like. Typically, the number of measurement regions is in the range from 5 to 20. The number of thermopiles may be increased as the number of measurement regions Px is increased. Alternatively, a plurality of multi-array thermopiles each including a predetermined number of thermopiles may be aligned along the width direction of the heating belt 31.

When a plurality of multi-array thermopiles are used as the first temperature sensor 51 and the second temperature sensor 52, the number of multi-array thermopiles can be reduced since they have wide viewing angles. This makes it possible to miniaturize the first temperature sensor 51 and the second temperature sensor 52 and reduce the space required for the first temperature sensor 51 and the second temperature sensor 52.

Also, not limited to thermopiles or multi-array thermopiles, a thermography or the like may be used as the first temperature sensor 51 and the second temperature sensor 52. In any case, the first temperature sensor 51 and the second temperature sensor 52 measures temperatures at a plurality of measurement regions so that it can detect the temperature of the circumferential surface of the heating belt 31, which forms the fixing nip N, over the whole region thereof.

Note that, when any of the thermopile, multi-array thermopile and thermography is used as the first temperature sensor 51 and the second temperature sensor 52, each of the first temperature sensor 51 and the second temperature sensor 52 can measure the temperature of the surface of the heating belt 31 over a predetermined range in the width direction, while it is fixed to a position facing the surface of the heating belt 31. This structure eliminates the need to provide a mechanism for causing the first temperature sensor 51 and the second temperature sensor 52 to move within the respective measurement regions. Thus, there is no need to use a complex mechanism for causing the first temperature sensor 51 and the second temperature sensor 52 to move within the respective measurement regions, which enables the first temperature sensor 51 and the second temperature sensor 52 to have simple structures. This prevents a failure or the like from occurring in the first temperature sensor 51 and the second temperature sensor 52, and prevents the reliability from being decreased due to such a failure or the like.

Note that, instead of the structure where the first temperature sensor 51 and the second temperature sensor 52 are fixed at positions facing the surface of the heating belt 31, the structure where one thermopile is moved along the width direction of the heating belt 31, or the structure where one thermopile is swung (oscillated) so that the measurement range of the thermopile reciprocates along the width direction of the heating belt 31 may be adopted. In that case, a mechanism for moving the thermopile is required, and the mechanism has a higher possibility of having a failure or the like than the structures without it. Although the structure may reduce the reliability, it reduces the cost because it requires only one thermopile.

In another example of the structure, one thermopile is fixed in the peripheral of the heating belt 31, and a reflector is provided to reflect light, which is radiated along the width direction of the heating belt 31, toward the fixed thermopile. In this case, a structure where the reflector is moved at a high speed may be adopted. This structure, compared to a structure where the first temperature sensor 51 and the second temperature sensor 52 themselves are moved at a high speed, is simple and requires a small number of components. This reduces the occurrence of failure or the like.

The resistance heating layer 31*b* provided on the reinforcement layer 31*a* of the heating belt 31 is formed in a predetermined cylindrical shape by evenly dispersing an electrically conductive filler and a high ionic conductor into a heat-resistant resin so that the whole circumference thereof has a uniform electrical resistivity.

As the heat-resistant resin used in the resistance heating layer 31*b*, PI (polyimide), PPS (polyphenylenesulfide), PEEK (polyether ether ketone) or the like is used, and among these, PI is preferable since it has the highest heat resistance. For this reason, PI is used in the present embodiment.

As the electrically conductive filler, powder of a metal material having a low electrical resistivity (a high electrical conductivity) and powder of a carbon compound having a high electrical resistivity (a low electrical conductivity) are preferably used. As the high ionic conductor powder, a high ionic conductor powder of an inorganic compound such as silver iodide (AgI), copper iodide (CuI) or the like is preferably used. As the metal material powder, microparticles of Ag, Cu, Al, Mg, Ni or the like are suitable. As the carbon compound powder, graphite, carbon black, carbon nanofibers, or carbon nanotube is suitable.

There is no possibility that the high ionic conductor powder may reduce the mechanical strength of the resistance heating layer 31*b*. However, when merely the high ionic conductor powder and the carbon compound powder having a high electrical resistivity are used, it is not easy to adjust the resistance heating layer 31*b* to a predetermined electrical resistivity such that a fixing device having power of approximately 500 W to 1500 W supplied from a commercial power source can generate a predetermined amount of heat. For this reason, a metal powder having a low electrical resistivity is also used. In this way, by using a metal powder, a carbon compound powder, and a high ionic conductor powder, it is possible to easily adjust the resistance heating layer 31*b* to a predetermined electrical resistivity, without reducing the mechanical strength.

Note that each of the metal powder having a low electrical resistivity, the carbon compound powder having a high electrical resistivity, and the high ionic conductor powder may be composed of two or more types of materials.

Also, it is preferable that each of the metal powder having a low electrical resistivity, the carbon compound powder having a high electrical resistivity, and the high ionic conductor powder is in fibrous form. This is because, when each of the metal powder, carbon compound powder and high ionic conductor powder is in fibrous form, they are likely to contact and percolate each other.

When silver iodide (AgI) or copper iodide (CuI) is used as the high ionic conductor powder, the effect of preventing an excessive temperature rise in the non-paper-passing region becomes remarkable since both AgI and CuI have a temperature (phase transition point) at which the resistance change rate greatly changes and the resistance value drastically decreases. In the case of AgI, the phase transition point is typically 147° C. However, the smaller the particle diameter of AgI is, the lower the phase transition point is. This applies to CuI as well.

Accordingly, it is possible to set the phase transition point to a predetermined temperature by appropriately selecting the particle diameter of AgI or CuI to be mixed in the material, depending on the fixing temperature. In particular, when the particle diameter of the material is small, AgI or CuI can be generated by a simple method of mixing, filtering, and drying, at normal temperature and normal pressure, a silver nitrate ($AgNO_3$) solution, a sodium iodide (NaI) solution, and a solution of PVP (Poly-N-vinyl-2-pyrrolidone) that is a silver-ion-conductive organic polymer. Also, it is possible to generate nano particles of different sizes in the range from 10 to 50 nm by modifying the density of the solution and/or the mixing procedure.

The particle diameter of the metal powder is preferably in the range from 0.01 to 10 μm. With such a particle diameter, the powder of a carbon compound having a high electrical resistivity and the high ionic conductor power twist together linearly over the entire length, and the resistance heating layer 31*b* has a uniform electrical resistivity as a whole.

The amount of the electrically conductive filler that is dispersed in the heat-resistant resin is preferably as follows: 50 to 300 weight % of metal powder having a low electrical resistivity; and 5 to 100 weight % of carbon compound powder having a high electrical resistivity and high ionic conductor powder. Note that, when any of the metal powder, carbon compound powder, and high ionic conductor powder exceeds 300 weight %, the electrical resistivity of the resistance heating layer 31*b* is likely to decrease excessively; and when any of the metal powder, carbon compound powder, and high ionic conductor powder is less than 50 weight %, the electrical resistivity of the resistance heating layer 31*b* is likely to increase excessively. In either case of exceeding 300 weight % or being less than 50 weight %, it is difficult to adjust to a predetermined volume resistivity. For this reason, the metal powder is preferably set in the range from 50 to 300 weight %.

The thickness of the resistance heating layer 31*b* can be arbitrarily set, but preferably is in the range approximately from 5 to 100 μm.

The electrical resistivity of the resistance heating layer 31*b* can be arbitrarily set based on the power supplied to the resistance heating layer 31*b*, the applied voltage, the thickness of the resistance heating layer 31*b*, the diameter and length of the fixing roller 33 in the width direction and the like, but preferably is in the range approximately from $1.0\times10^{-6}$ to $1.0\times10^{-2}\Omega\cdot m$, and more preferably is in the range approximately from $1.0\times10^{-5}$ to $5.0\times10^{-3}\Omega\cdot m$.

Note that, to adjust the volume resistivity of the resistance heating layer 31*b*, electrically conductive particles of a metal alloy, an intermetallic compound or the like may be added appropriately. Also, a glass fiber, whisker (needle-like single crystal of a metal), titanium oxide, potassium titanate or the like may be added to improve the mechanical strength of the resistance heating layer 31*b*.

Furthermore, aluminum nitride, alumina or the like may be added to improve the thermal conductivity of the resistance heating layer 31*b*.

Also, an imidization agent, coupling agent, surfactant agent, antifoam agent or the like may be added to manufacture the resistance heating layer 31*b* in a stable manner.

The resistance heating layer 31*b* is manufactured by, for example, applying a polyimide varnish containing evenly dispersed electrically conductive filler to a cylindrical mold to convert the polyimide varnish into an imide, wherein the polyimide varnish is obtained by polymerizing, in an organic solvent, aromatic tetracarboxylic dianhydride and aromatic diamine.

The elastic layer 31*c* of the heating belt 31 is made of a highly heat-resistant elastic material such as a silicone rubber, fluororubber or the like. In the present embodiment, a silicone (Si) rubber is used as the elastic layer 31*c*.

The releasing layer 31*d* of the heating belt 31 has releasability that is given by, for example, a fluorine-based tube, such as PFA (polyfluoroethylene), PTFA (polytetrafluoroethylene resin), or ETFE (ethylene-fluorinated ethylene copolymer resin), or a fluorine-based coating. The thickness of the releasing layer 31*d* is preferably in the range approximately from 5 to 100 μm. As the fluorine-base tube, for example, any of "PFA350-J", "451HP-J" and "951HP Plus", products made by Du Pont-Mitsui Fluorochemicals, is suitable.

The releasing layer 31*d* has the releasability with which the recording sheet S, having been pressed against the surface of the layer itself in the fixing nip N, is easily released therefrom.

The releasing layer 31*d* has typically 90 degrees or more of, and preferably 110 degrees or more of contact angle with water, and its surface roughness Ra is preferably in a range approximately from 0.01 to 50 μm. The releasing layer 31*d* may be electrically conductive. In the present embodiment, PFA is used as the releasing layer 31*d*.

The reinforcement layer 31*a*, resistance heating layer 31*b*, elastic layer 31*c* and releasing layer 31*d* have predetermined constant thicknesses respectively, and the heating belt 31 composed of these layers has sufficient hardness to maintain a cylindrical shape with a predetermined diameter when it is not pressed against the pressing roller 32. The heating belt 31 deforms to substantially the same shape as the circumferential surface of the pressing roller 32, following the deformation made by the fixing roller 33 and the pressing roller 32 pressing each other.

Note that the heating belt 31 is not limited to the above-described four-layer structure, but may have a two-layer structure composed of the resistance heating layer 31*b* and the releasing layer 31*d*. Also, in either case, the heating belt 31 may further include a resin layer made of PI, PPS or the like for insulation. Note that, in any case, the resistance heating layer 31*b* is located more on the inner circumferential side than the releasing layer 31*d*.

The electrically conductive members constituting the electrode parts 31*g* may be formed by applying a metal such as Cu, Al, Ni, brass, or phosphor bronze directly to the resistance heating layer 31*b* by a chemical plating or an electric plating.

Note that, when the electrode parts 31*g* are formed by the metal plating, two types of metals are preferably plated. For example, the electrode parts 31*g* may be formed by first plating Cu directly on the resistance heating layer 31*b* by the chemical plating, and then plating Ni on the Cu layer by the electric plating.

Also, not limited to the above, the electrode parts 31*g* may be formed by attaching a foil of a metal such as Cu or Ni onto the resistance heating layer 31*b* by an electrically conductive adhesive.

Alternatively, the electrode parts 31*g* may be formed by applying an electrically conductive ink or an electrically conductive paste onto the resistance heating layer 31*b*. Furthermore, the electrode parts 31*g* may be formed by attaching an electrically conductive tape to the resistance heating layer 31*b*.

As illustrated in FIGS. 2 and 3, the fixing roller 33, which is provided within the circulating movement range of the heating belt 31, includes a cored bar 33*a* provided at the axial center, and an elastic layer 33*b* laminated on the outer circumferential surface of the cored bar 33*a*. Both ends of the cored bar 33*a* project outside from the elastic layer 33*b* along the axial direction.

The cored bar 33*a* is formed by fitting a cylindrical body (solid or hollow), which is made of a metal such as aluminum, iron or the like and has a diameter of approximately 10 to 30 mm, on the outer side of a shaft having a predetermined diameter, and both ends of the shaft project outside from the cored bar 33*a* along the axial direction. The elastic layer 33*b* is made of a highly heat-resistant elastic material such as a silicone rubber or fluororubber. The length of the elastic layer in the axial direction is approximately the same as the length of the heating belt 31 in the axial direction.

The pressing roller 32 includes a cored bar 32*a*, an elastic layer 32*b* laminated on the outer circumferential surface of the cored bar 32*a*, and an elastic layer 32*b* laminated on the outer circumferential surface of the cored bar 32*a*, and a releasing layer 32*c* laminated on the circumferential surface of the elastic layer 32*b*. The outer diameter of the pressing roller 32 is in the range of approximately from 20 to 100 mm.

As is the case of the cored bar 33*a* of the fixing roller 33, the cored bar 32*a* of the pressing roller 32 is formed by fitting a cylindrical body, which is made of a metal such as aluminum, iron or the like and has a diameter of approximately 10 to 30 mm, on the outer side of a shaft having a predetermined diameter. The elastic layer 32*b* is made of a highly heat-resistant elastic material such as a silicone rubber or fluororubber, and has a thickness of approximately 1 to 20 mm.

The releasing layer 32*c* has releasability for the recording sheet, the releasability being given by, for example, a fluorine-based tube, such as PFA (polyfluoroethylene), PTFA (polytetrafluoroethylene resin), or ETFE (ethylene-fluorinated ethylene copolymer resin), or a fluorine-based coating. The releasing layer 32*c* has a thickness of approximately 5 to 100 μm. Note that releasing layer may be electrically conductive to prevent the offset of toner.

The pressing roller 32 is set to be parallel to the fixing roller 33 and urged toward the heating belt 31 by a not-illustrated urging unit (for example, pulling spring). This causes the outer circumferential surface of the pressing roller 32 to be pressed against the outer circumferential surface of the heating belt 31, causing the heating belt 31 to be pressed against the fixing roller 33. The portions of the heating belt 31 and the pressing roller 32 that press against each other form the fixing nip N through which the recording sheet S passes.

As illustrated in FIG. 2, the pressing roller 32 is driven to rotate in the direction indicated by the arrow D1 by a fixing motor 38. The heating belt 31 is pressed by the pressing roller 32 and the fixing roller 33, and rotates (makes a circulating movement) in the direction indicated by the arrow D2 in FIG. 2, following the rotation of the pressing roller 32. The fixing roller 33 pressed by the heating belt 31 rotates following the rotation of the heating belt 31.

Note that, in the fixing device 30, the fixing motor 38 may rotate the fixing roller 33, instead of driving the pressing roller 32 to rotate. Alternatively, the fixing motor 38 may rotate both the pressing roller 32 and the fixing roller 33.

The recording sheet S is transported to the fixing nip N while the pressing roller 32 and the heating belt 31 are rotating, and the heating belt 31 is heated by a current supplied from the alternating-current power source 34 via the power adjusting unit 35.

The recording sheet S is transported to the fixing nip N with reference to the center in the width direction, thus when the recording sheet S passes through the fixing nip N, the center position in the width direction (perpendicular to the circulating movement direction) of the heating belt 31 matches the width direction (perpendicular to the transportation direction). When passing through the fixing nip N, the recording sheet S is pressed and heated by the heating belt 31 that has been heated, and the unfixed toner image on the recording sheet S is fixed on the recording sheet S.

<Operation of Fixing Device>

In the fixing device 30 having the above-described structure, when a print job is received, the fixing motor 38 is driven. This causes the pressing roller 32 to rotate and the heating belt 31 to make a circulating movement (rotate). Also, when the heating belt 31 rotates, the alternating-current power from the alternating-current power source 34 is adjusted by the power adjusting unit 35 and applied to between the electricity supplying members 37. When the heating belt 31 is not rotating, the alternating-current power from the alternating-current power source 34 is not applied to between the electricity supplying members 37.

In that case, the current supplied to one of the electricity supplying members 37 flows through an electrode part 31*g* pressed to the electricity supplying member 37, and then the resistance heating layer 31*b* to the other electrode part 31*g* and the other electricity supplying member 37. This causes the resistance heating layer 31*b* to emit heat and the whole heating belt 31 is heated.

The recording sheet S with a toner image transferred thereon is transported to the fixing nip N that is formed by the heating belt 31 and the pressing roller 32 pressing each other in the above-described state. When passing through the fixing nip N, the recording sheet S is heated and pressed, and the toner image on the recording sheet S is fixed onto the recording sheet S.

During the fixing operation, the amount of power supplied from the alternating-current power source 34 to the electricity supplying members 37 is adjusted by the power adjusting unit 35 based on the surface temperature of the heating belt 31 detected by the first temperature sensor 51 and the second temperature sensor 52, and the heating belt 31 is set to a predetermined fixing temperature (for example, 180° C.).

Also, an abnormality judgment control is executed to judge whether or not an abnormality such as a scratch has occurred in the resistance heating layer 31*b* of the heating belt 31, based on the surface temperatures of the heating belt 31 measured at the measurement regions Px by the first temperature sensor 51 and the second temperature sensor 52.

<Structure of Control System>

Figure 5:
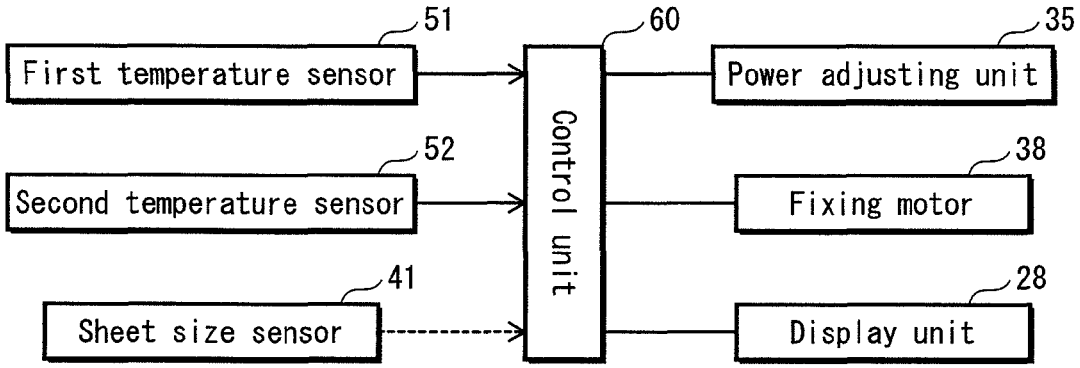
FIG. 5 is a block diagram illustrating the structure of the main parts of the control system for controlling the fixing device illustrated in FIG. 2.

FIG. 5 is a block diagram illustrating the structure of the main parts of the control system for controlling the fixing device 30. The fixing device 30 is controlled by a control unit 60 for controlling the whole printer.

The control unit 60 receives outputs of the first temperature sensor 51 and the second temperature sensor 52 (outputs of all thermopiles provided therein) of the temperature detecting unit 50 provided in the fixing device 30. Also, the control unit 60 is structured to control the power adjusting unit 35 and the fixing motor 38, wherein the power adjusting unit 35 adjusts the amount of power supplied to the electricity supplying members 37, and the fixing motor 38 rotates the pressing roller 32 to cause the heating belt 31 to make a circulating movement.

Note that, although a sheet size sensor 41 is illustrated in FIG. 5, the sheet size sensor 41 is not necessary in the present embodiment, but is used in Embodiment 2 as will be described later.

The first temperature sensor 51 and the second temperature sensor 52 output values of temperatures measured by all thermopiles provided therein. The control unit 60, based on the temperatures measured by the thermopiles, judges whether or not an abnormality such as a scratch has occurred in the heating belt 31. When the control unit 60 judges that an abnormality such as a scratch has occurred in the heating belt 31, the control unit 60 displays the judgment result on a display device 28 which is, for example, a liquid-crystal display provided in an operation panel.

The control unit 60 adjusts the amount of power supplied to the electricity supplying members 37 by controlling the power adjusting unit 35 so that all values of the surface temperature of the heating belt 31 detected by the first temperature sensor 51 and the second temperature sensor 52 are within a predetermined range. In that case, when any value of the surface temperature of the heating belt 31 detected by the first temperature sensor 51 and the second temperature sensor 52 is in an abnormal state exceeding a predetermined temperature, the control unit 60 controls the power adjusting unit 35 to stop supplying the power to the heating belt 31. When the surface temperature of the heating belt 31 exceeds a threshold, the supply of the power to the heating belt 31 is stopped. The threshold of the surface temperature of the heating belt 31 varies depending on the dimensions, material or the like of the heating belt 31, but is typically 260° C. or higher.

Also, the present invention is not limited to the structure where the power adjusting unit 35 adjusts the amount of power supplied from the alternating-current power source 34 to the electricity supplying members 37 based on the surface temperatures of the heating belt 31 detected by the first temperature sensor 51 and the second temperature sensor 52 over the whole width of the heating belt 31. That is to say, for example, a temperature sensor for detecting the temperature at the center of the heating belt 31 in the width direction may be provided instead of the first temperature sensor 51 and the second temperature sensor 52, and based on the temperature detected by the temperature sensor, the power adjusting unit 35 may be controlled to adjust the amount of power supplied to the electricity supplying members 37.

<Abnormality Judgment Control>

The following describes the principle of the abnormality judgment control for judging whether or not an abnormality such as a scratch has occurred in the heating belt 31.

When the resistance heating layer 31*b* of the heating belt 31 has a scratch extending along the circumferential direction of the heating belt 31, the current cannot flow the portion having the scratch in the width direction of the heating belt 31, but flows bypassing the scratch. In that case, the amount of current flowing in the vicinities of both ends of the scratch (both ends in the circumferential direction) increases, and the amount of heat increases. As a result, the vicinities of both ends of the scratch become higher in temperature than the vicinity of the center.

Figure 6:
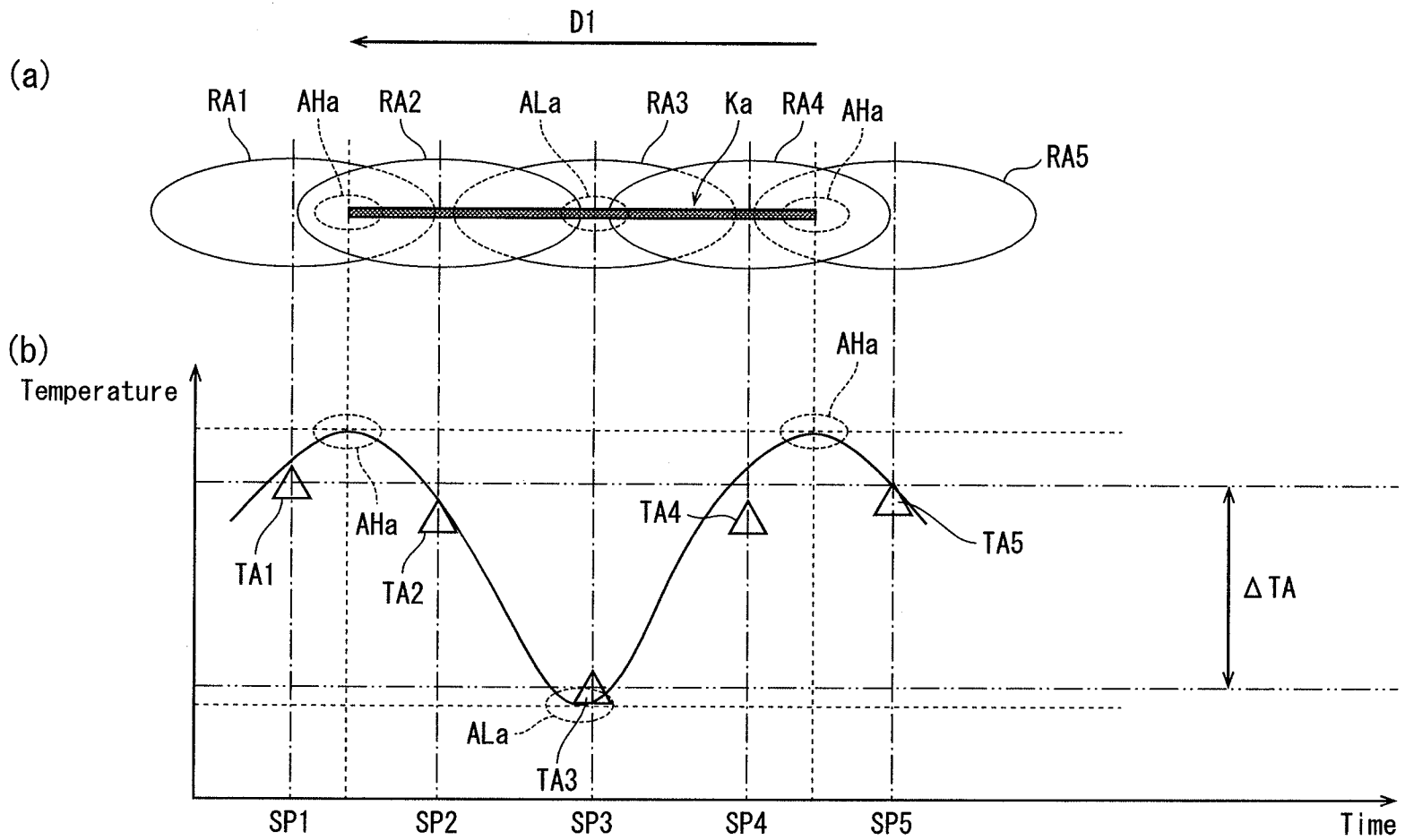
FIG. 6 part (a) is a schematic diagram illustrating one example of sampling timings of the temperatures measured in one measurement region by the temperature detecting unit used in the abnormality judgment control in the case where a scratch extending along the circumferential direction of the heating belt has occurred therein.

FIG. 6 part (a) is a schematic diagram illustrating one example of sampling timings of the temperatures measured in a measurement region Px by the temperature detecting unit 50 used in the abnormality judgment control in the case where a scratch Ka extending along the circumferential direction of the heating belt has occurred therein.

Note that the circulating movement direction (rotational direction) of the heating belt 31 is indicated by the arrow D1.

FIG. 6 part (b) is a graph showing the change in surface temperature of the heating belt 31 in the vicinities of the scratch Ka illustrated in FIG. 6 part (a).

As illustrated in FIG. 6 part (b), the heating belt 31 has the highest temperatures in the vicinities of both ends of the scratch Ka in the longitudinal direction, and has the lowest temperature in the vicinity of the center in the longitudinal direction.

As illustrated in FIG. 6 part (a), the thermopile, whose measurement region Px includes the scratch Ka, samples an average temperature of a range of a predetermined area in the measurement region Px, at predetermined timings. For example, for the scratch Ka, the thermopile samples measured temperatures from a range having a predetermined area (the range being composed of the first to fifth measurement ranges RA1 to RA5 aligning in the circumferential direction of the thermopile) at five sampling timings (the first to fifth sampling timings SP1 to SP5).

FIG. 6 part (a) indicates the relationship between the scratch Ka and the measurement ranges RA1 to RA5 of the first to fifth sampling timings. In the present case, the center of the third measurement range RA3 of the third sampling time SP3 matches the center of the scratch Ka in the longitudinal direction. The first measurement range RA1 corresponding to the first sampling time SP1 includes a local high-temperature region (a high-temperature region AHa indicated by the dotted line in FIG. 6 parts (a) and (b)) in the vicinity of an end of the scratch Ka located on the downstream side in the rotational direction. However, the high-temperature region AHa is shifted toward the upstream side in the rotational direction with reference to the first measurement range RA1, and the high-temperature region AHa has a wide region of temperatures that are lower than the temperature of the high-temperature region AHa. Due to this, the first measured temperature TA1 (the average temperature of the first measurement range RA1) is lower than the actual temperature of the high-temperature region AHa.

Note that the signs A (triangle) in FIG. 6 part (b) represent the first to fifth measured temperatures TA1 to TA5 for the first to fifth measurement ranges RA1 to RA5. The first measured temperature TA1 of this case is, for example, approximately 200° C.

The second measurement range RA2 corresponding to the second sampling timing SP2 also includes the high-temperature region AHa in the vicinity of the end of the scratch Ka located on the downstream side in the rotational direction. However, since it has a wide region of temperatures that are lower than the temperature of the high-temperature region AHa, the second measured temperature TA2 (the average temperature of the second measurement range RA2) is also lower than the actual temperature of the high-temperature region AHa.

The third measurement range RA3, which corresponds to the third sampling timing SP3 and includes the center of the scratch Ka in the longitudinal direction, includes a local low-temperature region (low-temperature region ALa). However, since it has a wide region of temperatures that are higher than the temperature of the low-temperature region ALa, the third measured temperature TA3 (the average temperature of the third measurement range RA3) is higher than the actual temperature of the low-temperature region ALa, and is, for example, 160° C. In this case, however, since the center of the third measurement range RA3 matches the center of the scratch Ka in the longitudinal direction, the third measurement range RA3 has a wide region of temperature falls that are smaller than those of the low-temperature region ALa, thus the difference between the third measured temperature TA3 and the actual temperature is small.

The fourth measurement range RA4 corresponding to the fourth sampling timing SP4 includes the high-temperature region AHa in the vicinity of an end of the scratch Ka located on the upstream side in the rotational direction. However, since it has a wide region of temperatures that are lower than the temperature of the high-temperature region AHa, the fourth measured temperature TA4 is approximately the same as the second measured temperature TA2 of the second measurement range RA2.

Furthermore, the fifth measurement range RA5 corresponding to the fifth sampling timing SP5 includes the high-temperature region AHa in the vicinity of the end of the scratch Ka located on the upstream side in the rotational direction. However, since it has a wide region of temperatures that are lower than the temperature of the high-temperature region AHa, the fifth measured temperature TA5 is approximately the same as the first measured temperature TA1 of the first measurement range RA1 (appximately 200° C.).

In the present case, the first measured temperature TA1 at the first sampling timing SP1 (the average temperature of the first measurement range RA1 that includes the high-temperature region AHa: 200° C., for example) is the highest temperature (maximum value) Tmax. Also, the third measured temperature TA3 at the third sampling timing SP3 (the average temperature of the third measurement range RA3 that includes the low-temperature region: 160° C., for example) is the lowest temperature (minimum value) Tmin.

In this way, when the resistance heating layer 31*b* has a scratch extending along the circumferential direction of the heating belt 31, both ends of the scratch become local high-temperature regions (AHa), and the central portion between the ends becomes a local low-temperature region (ALa). Accordingly, while the measurement region Px relatively moves in the circumferential direction over the whole circumference of the heating belt 31, a temperature difference Tpp between the maximum value Tmax and the minimum value Tmin of the sampled measured temperatures increases (to 30° C., for example).

Note that, when the resistance heating layer 31*b* of the heating belt 31 does not have a scratch in the measurement regions Px of the thermopile, the temperature measured while the measurement region Px relatively moves over the whole circumference of the heating belt 31 hardly varies, and is an approximately constant value that is approximately the same as the fixing temperature (180° C.). In this case, therefore, the temperature difference Tpp between the maximum value Tmax and the minimum value Tmin of the sampled measured temperatures of the thermopiles is small (for example, equal to or less than 5° C.).

In view of the above, the present embodiment provides sampling, at predetermined timings, the temperatures measured by the thermopiles so that the temperature distribution over the whole circumference of the belt can be obtained for each of the measurement regions Px, obtaining the temperature difference Tpp between the maximum value Tmax and the minimum value Tmin of the sampled measured temperatures for each of the measurement regions Px, and comparing the temperature difference Tpp obtained for a measurement region with the temperature difference Tpp obtained for another measurement region with regard to each pair of measurement regions. When a differential ΔTpp between temperature differences Tpp is greater than a predetermined threshold Tth, it is judged that an abnormality such as a scratch has occurred in the resistance heating layer 31*b* at a portion included in the measurement region Px whose value of temperature difference Tpp is greater than the value of temperature difference Tpp of the other measurement region Px, among the measurement regions constituting the comparison pair.

Figure 7:
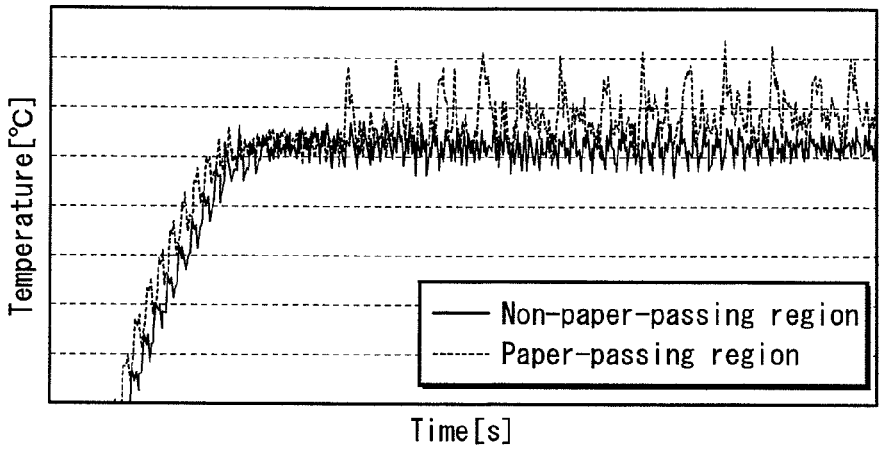
FIG. 7 is a graph illustrating the change in the surface temperatures of the heating belt measured for each of the paper-passing region and the non-paper-passing region, during a fixing operation executed by the fixing device.

The reason is as follows. FIG. 7 is a graph illustrating the change in the surface temperatures of the heating belt 31 in the rotating state, the surface temperatures being measured for each of the paper-passing region and the non-paper-passing region, when a plurality of recording sheets S are transported continuously to the fixing nip N of the fixing device 30 and toner images on the recording sheets S are fixed thereon. Note that, in this example, the resistance heating layer 31*b* of the heating belt 31 does not have a scratch or the like. In FIG. 7, the dotted line represents temperatures measured in the paper-passing region, and the solid line represents temperatures measured in the non-paper-passing region.

As shown in FIG. 7, the surface temperature of the heating belt 31 increases with the rotation of the heating belt 31 during a period from the start of the heating of the resistance heating layer 31*b* of the heating belt 31 until the temperature reaches the fixing temperature, that is to say, during a period before the recording sheet S is transported to the fixing nip N.

In this period, the surface temperature of the heating belt 31 is not constant and changes in the circumferential direction over the whole circumference of the belt, in each of the paper-passing region and the non-paper-passing region. This temperature change occurs due to non-uniformity of the thickness of the resistance heating layer 31*b* of the heating belt 31 or the like, and substantially the same temperature change is observed for each rotation of the heating belt 31.

During a period after the heating belt 31 reaches a predetermined fixing temperature and a plurality of recording sheets S pass through the fixing nip N continuously, the surface temperature of the paper-passing region of the heating belt 31 increases greatly during a period after one recording shift passes through the fixing nip N and before the next recording sheet S reaches the fixing nip N. On the other hand, the temperature does not rise in the non-paper-passing region as in the paper-passing region since the recording sheet S does not pass the non-paper-passing region, and the temperature change along the circumferential direction there is approximately the same as that during the period before the temperature reaches the fixing temperature.

Accordingly, when one of the measurement regions Px of a pair, which are combined for making the comparison of the temperature difference Tpp, belongs to the paper-passing region and the other belongs to the non-paper-passing region, there is a possibility that the differential ΔTpp between temperature differences Tpp of the temperatures measured by the thermopiles corresponding to the measurement regions Px making the pair is greater than the predetermined threshold (Tth). In that case, it may be erroneously judged that there is a scratch in a portion of the resistance heating layer 31*b* that corresponds to any of the two measurement regions Px making the pair, although, in the actuality, there is no scratch in any portion of the resistance heating layers 31*b* corresponding to the two measurement regions Px.

In this way, the temperature change on the surface of the heating belt 31 differs greatly between the paper-passing region and the non-paper-passing region when the recording sheet S passes through the fixing nip N. In view of this, in the present embodiment, the combination of thermopiles (one thermopile from the first temperature sensor 51 and another thermopile from the second temperature sensor 52) is set in advance so that measurement regions Px measured by the thermopiles of the combination are both included in the paper-passing region, or are both included in the non-paper-passing region.

The lengths of the paper-passing region and the non-paper-passing region in the nip change depending on the size of the recording sheet S that passes through the nip. However, in the printer of the present embodiment, the recording sheet S is transported by the center-based transportation. Accordingly, it is possible to set the combination of the thermopiles so that the corresponding measurement regions located at symmetrical positions on either side of the reference position, which is the center of the width of the heating belt 31 in the nip, are both included in the paper-passing region or the non-paper-passing region. As a result, in the present embodiment, the size of the recording sheet S transported to the nip is not detected, but the combination of thermopiles is set in advance so that the thermopiles of the combination correspond to measurement regions located at symmetrical positions on either side of the reference position.

Also, when there is a scratch Ka in the resistance heating layer 31*b*, the current may not be able to flow along the width direction of the heating belt 31 from a measurement region Px that includes the scratch Ka (hereinafter referred to as "target measurement region PxO") to a portion, which is located on the downstream side of the scratch Ka, of a measurement region Px (hereinafter referred to as "comparative measurement region PxR") that is adjacent, on the downstream side in the current flow direction, to the target measurement region PxO, and the current density in the portion may decrease.

In that case, the temperature difference Tpp between the maximum value and the minimum value of the temperatures measured in the comparative measurement region PxR increases although the region does not have a scratch. As a result, when the temperature differences Tpp of the target measurement region PxO and the comparative measurement region PxR are compared with each other, the differential ΔTpp between the temperature differences Tpp may not reach the predetermined threshold Tth, and it may fail to be judged that the scratch Ka has occurred in the target measurement region PxO.

Figure 8:
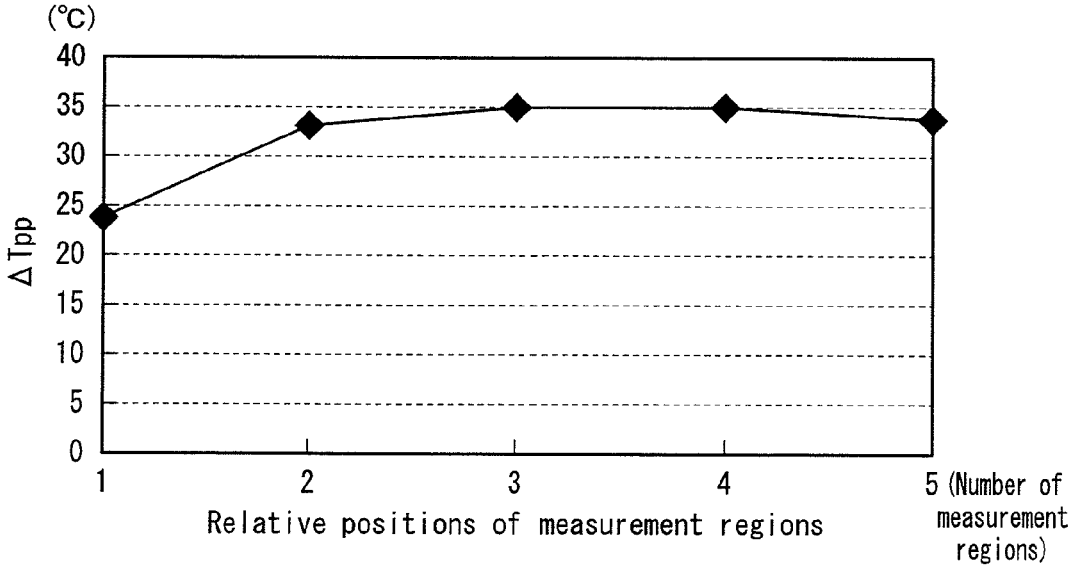
FIG. 8 is a graph indicating a possibility that the judgment on the scratch may be affected by the comparison of the temperature difference between two thermopiles of a pair, the temperature difference being a difference between the maximum value and the minimum value of the measured temperatures.

FIG. 8 is a graph indicating a possibility that the differential ΔTpp between the temperature differences Tpp of the target measurement region PxO and the comparative measurement region PxR may not meet the purpose of detecting the presence of a scratch when the scratch Ka has occurred in the target measurement region PxO and the comparative measurement region PxR is adjacent to the target measurement region PxO. In the graph of FIG. 8, the horizontal axis represents relative positions of the comparative measurement region PxR to the target measurement region PxO, and value "1" in the horizontal axis indicates that the comparative measurement region PxR is adjacent to the target measurement region PxO, and values "2" to "5" indicate that the comparative measurement region PxR is distant from the target measurement region PxO with one to four measurement regions therebetween, respectively.

The vertical axis FIG. 8 represents the differential ΔTpp between the temperature differences Tpp, each between the maximum value Tmax and the minimum value Tmin of the temperatures measured in each of the target measurement region PxO and the comparative measurement region PxR.

When the target measurement region PxO and the comparative measurement region PxR are adjacent to each other, the current may not flow into a portion of the comparative measurement region PxR that is adjacent to the scratch Ka of the target measurement region PxO, and the portion may decrease in temperature. When this happens, the temperature difference Tpp in the comparative measurement region PxR becomes a great value. Reflecting this phenomenon, the differential ΔTpp, between the temperature differences Tpp, each between the maximum value Tmax and the minimum value Tmin of the temperatures measured in each of the target measurement region PxO and the comparative measurement region PxR, in FIG. 8 is small, approximately 24° C. In this case, it may fail to be judged that the scratch Ka has occurred in the target measurement region PxO.

On the other hand, when the comparative measurement region PxR is distant from the target measurement region PxO with at least one measurement region therebetween, the differential ΔTpp, between the temperature differences Tpp, each between the maximum value Tmax and the minimum value Tmin of the temperatures measured in each of the target measurement region PxO and the comparative measurement region PxR, in FIG. 8 is higher than 30° C., showing little influence from the scratch Ka having occurred in the target measurement region PxO.

The above-described circumstances taken into account, in the present embodiment, the first to eighth measurement regions PxA1 to PxA8 of the first temperature sensor 51 are combined one-to-one with the first to eighth measurement regions PxB1 to PxB8 of the second temperature sensor 52 such that the measurement regions of each pair, corresponding to two thermopiles between which comparison of the temperature difference Tpp is made, are not adjacent to each other.

Figure 9:
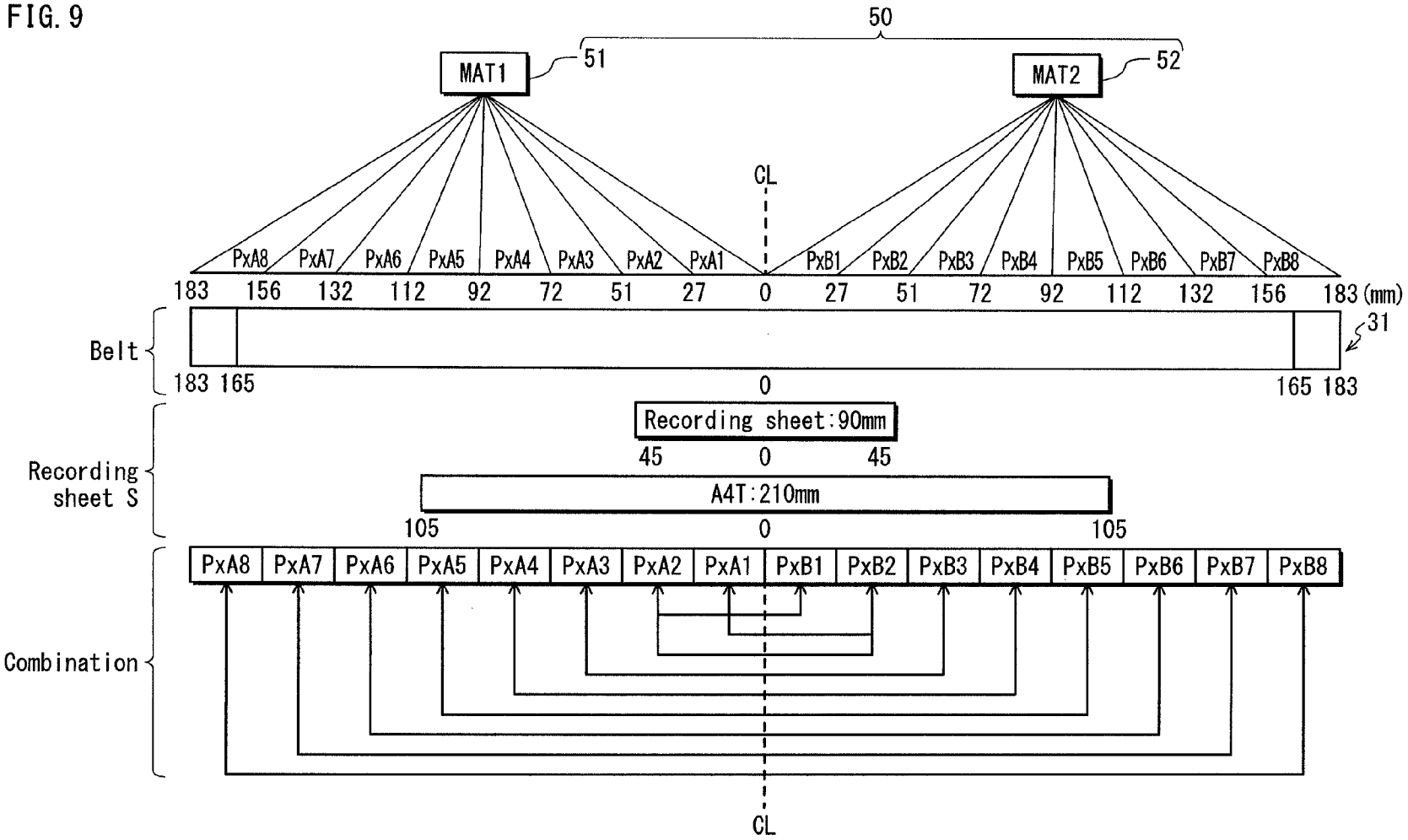
FIG. 9 is a schematic diagram illustrating combinations of measurement regions measured by the thermopiles, wherein the temperature difference between the maximum value and the minimum value of the measured temperatures is compared between two thermopiles of each pair, in the case where the recording sheet is transported by the center-based transportation.

FIG. 9 is a schematic diagram illustrating combinations of measurement regions Px measured by the thermopiles, wherein the temperature difference Tpp between the maximum value and the minimum value of the measured temperatures is compared between two thermopiles of each pair to judge whether or not there is a scratch Ka, in the case where the recording sheet S is transported by the center-based transportation as in the present embodiment. FIG. 10 is a table indicating the combinations of the measurement regions Px. Note that the upper portion of FIG. 10 illustrates the measurement regions Px of the first temperature sensor 51 and the second temperature sensor 52, and the lower portion of FIG. 10 illustrates the combinations of the measurement regions Px of the first temperature sensor 51 and the second temperature sensor 52.

Note that the heating belt 31 is 366 mm in width, and thus the distance between the center line CL and either end of the heating belt 31 in the width direction is 183 mm. When the recording sheet S is transported center-based, the center of the recording sheet S in the direction (the width direction) perpendicular to the transportation direction matches the center line CL.

Also, FIG. 9 provides distances from the center line CL, which extends passing through the center of the width of the heating belt 31, to the outer ends (both ends in the width direction), in correspondence with the first to eighth measurement regions PxA1 to PxA8 of the first temperature sensor 51, and the first to eighth measurement regions PxB1 to PxB8 of the second temperature sensor 52 of the temperature detecting unit 50.

The first to eighth measurement regions PxA1 to PxA8 of the first temperature sensor 51 and the first to eighth measurement regions PxB1 to PxB8 of the second temperature sensor 52 are respectively symmetrical with respect to the center line CL that extends passing the center of the width of the heating belt 31.

Note that the minimum size of the recording sheet S transported center-based is 90 mm in the width direction of the heating belt 31. FIG. 9 schematically illustrates the recording sheet S of the minimum size transported to the fixing nip N. FIG. 9 also indicates the case where a recording sheet S of the A4 size is transported to the fixing nip N by the center-based transportation, namely in the state where the width direction of the recording sheet S (represented by "A4T" in FIG. 9, the width being 210 mm) extends along the width direction of the heating belt 31.

When the recording sheet S is transported by the center-based transportation, the paper-passing region in the fixing nip N for the recording sheet S of the minimum size corresponds to, for example, four measurement regions that are the first measurement region PxA1 and the second measurement region PxA2 of the first temperature sensor 51 and the first measurement region PxB1 and the second measurement region PxB2 of the second temperature sensor 52. In this case, the non-paper-passing region corresponds to the third to eighth measurement regions PxA3 to PxA8 and the third to eighth measurement regions PxB3 to PxB8.

Similarly, when the recording sheet S of the A4 size is transported in the state where the width direction is along the width direction of the heating belt 31 (represented by "A4T" in FIG. 9), the paper-passing region corresponds to the first to fifth measurement regions PxA1 to PxA5 of the first temperature sensor 51 and the first to fifth measurement regions PxB1 to PxB5 of the second temperature sensor 52, and the non-paper-passing region corresponds to the sixth to eighth measurement regions PxA6 to PxA8 and the sixth to eighth measurement regions PxB6 to PxB8.

In the present embodiment in which the recording sheet S is transported center-based, when any of the measurement regions PxA1 to PxA8 of the first temperature sensor 51 includes a part of the paper-passing region, a measurement region of the second temperature sensor 52 that is located symmetrical with the measurement region with respect to the center line CL also includes a part of the paper-passing region. Similarly, when any of the measurement regions PxA1 to PxA8 of the first temperature sensor 51 is included in the non-paper-passing region, a measurement region of the second temperature sensor 52 that is located symmetrical with the measurement region with respect to the center line CL is also included in the non-paper-passing region.

Also, except for the first measurement region PxA1 and the second measurement region PxA2 of the first temperature sensor 51 and the first measurement region PxB1 and the second measurement region PxB2 of the second temperature sensor 52, one or more measurement regions Px exist between each of the third to eighth measurement regions PxA3 to PxA8 of the first temperature sensor 51 and a corresponding one of the third to eighth measurement regions PxB3 to PxB8 of the second temperature sensor 52, which are respectively located at the symmetrical positions with respect to the center line CL. For this reason, each of the thermopiles corresponding to the third to eighth measurement regions PxA3 to PxA8 of the first temperature sensor 51 is combined with a corresponding one of the thermopiles corresponding to the third to eighth measurement regions PxB3 to PxB8 of the second temperature sensor 52.

On the other hand, the first measurement region PxA1 of the first temperature sensor 51 and the first measurement region PxB1 of the second temperature sensor 52 are adjacent to each other. Thus the setting is made so that the thermopile corresponding to the first measurement region PxA1 of the first temperature sensor 51 is not combined with the thermopile corresponding to the first measurement region PxB1 of the second temperature sensor 52.

For this reason, the thermopile corresponding to the first measurement region PxA1 of the first temperature sensor 51 is combined with the thermopile corresponding to the second measurement region PxB2 of the second temperature sensor 52, and the thermopile corresponding to the second measurement region PxA2 of the first temperature sensor 51 is combined with the thermopile corresponding to the first measurement region PxB1 of the second temperature sensor 52.

In this way, all thermopiles of the first temperature sensor 51 are combined one-to-one with all thermopiles of the second temperature sensor 52 for measurement of temperatures over the whole width of the heating belt 31 such that the two measurement regions Px measured by the thermopiles combined as a pair are not adjacent to each other, and the measurement regions Px measured by the thermopiles of a pair are both included in the paper-passing region or the non-paper-passing region. All of the (eight) combinations of thermopiles set as described above are stored in advance in the control unit 60.

Note that the measurement regions Px measured by the thermopiles of the first temperature sensor 51 and the second temperature sensor 52 are assigned with respective lengths along the width direction of the heating belt 31 so that four or more measurement regions Px are included in the paper-passing region of the recording sheet S of the minimum size. This is because, if only three or less measurement regions Px are included in the paper-passing region of the recording sheet S of the minimum size, it is impossible to set the combinations of the thermopiles such that the two measurement regions Px measured by the thermopiles combined as a pair for comparison of temperature differences Tpp are not adjacent to each other.

Figure 11:
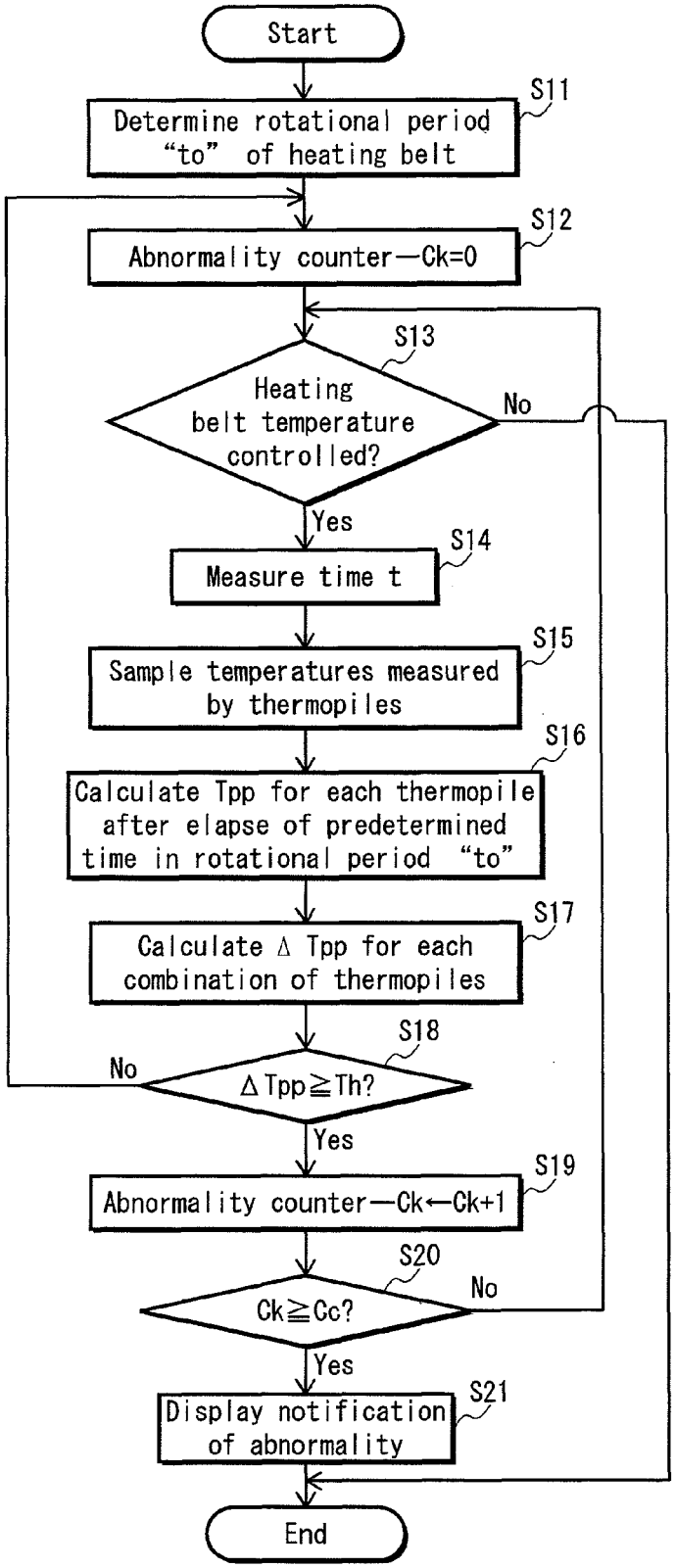
FIG. 11 is a flowchart illustrating the procedure of the abnormality judgment control in the case where the recording sheet is transported by the center-based transportation.

FIG. 11 is a flowchart illustrating the procedure of the abnormality judgment control executed by the control unit 60. The abnormality judgment control is performed as follows: when a print job is received, all of the thermopiles, which are provided in the first temperature sensor 51 and the second temperature sensor 52 of the temperature detecting unit 50, measure the temperatures in the respective measurement regions Px; with regard to each pair of thermopiles, temperature differences Tpp, which are each a difference between the maximum value Tmax and the minimum value Tmin of the temperatures measured by the thermopiles, are compared with each other, wherein each pair of thermopiles has been set in advance to correspond to a pair of measurement regions Px; and when a differential ΔTpp between temperature differences Tpp is greater than the threshold Tth, it is judged that there is a scratch extending along the circumferential direction in the resistance heating layer 31*b*.

The abnormality judgment control is started when the temperature adjustment control in the resistance heating layer 31*b* of the heating belt 31 is started after a print job is received. Accordingly, the abnormality judgment control is executed in both the warm-up of the fixing device 30 and the execution of the fixing operation.

When the abnormality judgment control is started, the control unit 60 first determines rotational period "to" of the heating belt 31 (see step S11 in FIG. 11, the same hereinafter). Note that the rotational period "to" of the heating belt 31 is determined based on whether the recording sheet S transported to the fixing device 30 is regular paper or thick paper. For example, when the recording sheet S transported to the fixing device 30 is regular paper, the transportation speed of the recording sheet S is set to be faster than in the case of the thick paper, and the rotational period "to" of the heating belt 31 becomes shorter. On the other hand, when the recording sheet S is thick paper, the rotational period "to" of the heating belt 31 becomes longer.

Next, an abnormality counter is reset to the initial state (Ck=0), wherein the abnormality counter counts the number of abnormalities that occur in the resistance heating layer 31*b* of the heating belt 31 and are detected based on the temperatures measured by the thermopiles (step S12). The abnormality counter is provided for prevention of an erroneous judgment that an abnormality has occurred in the resistance heating layer 31*b* of the heating belt 31, wherein the erroneous judgment might occur when the temperatures measured by the thermopiles are affected by noise or the like. How the abnormality counter prevents such an erroneous judgment is described below.

Subsequently, the control unit 60 checks whether or not the temperature adjustment control has been performed continuously on the resistance heating layer 31*b* of the heating belt 31 (step S13).

When it is confirmed that the temperature adjustment control has been performed continuously on the resistance heating layer 31*b* of the heating belt 31 (Yes in step S13), a timer is started to measure an elapse time "t" to determine the control timing for the abnormality judgment which is performed based on the temperatures measured by the thermopiles (step S14).

After this, the temperatures measured by all thermopiles are sampled at predetermined sampling timings until the time "t" measured by the timer reaches the rotational period "to" of the heating belt 31 (step S15). When the time "t" measured by the timer reaches the rotational period "to" of the heating belt 31, the maximum values Tmax and the minimum values Tmin are extracted from the measured temperatures T of all thermopiles sampled during the rotational period "to", and the temperature difference Tpp between the maximum value Tmax and the minimum value Tmin is calculated (step S16). After this, supposing that, for example, the rotational period "to" is one second, each time one second passes, the temperature difference Tpp between the maximum value Tmax and the minimum value Tmin is calculated from the measured temperatures T of all thermopiles obtained during the one rotational period "to".

Also, each time the temperature difference Tpp is calculated in this way, the differential ΔTpp between temperature differences Tpp of the temperatures measured by the thermopiles corresponding to the combinations of measurement regions as illustrated in FIGS. 9 and 10 is calculated for each pair of thermopiles (step S17). Each of the calculated differences ΔTpp is compared with the predetermined threshold Th (step S18).

When it is judged that all of the differences ΔTpp calculated based on the temperature differences Tpp of the temperatures measured by all combinations of thermopiles are smaller than the threshold Th (No in step S18), it is judged that any of the measurement regions Px for the resistance heating layer 31*b* of the heating belt 31 does not have a scratch or the like (no abnormality has occurred), and the control returns to step S12 and the abnormality counter is reset to the initial state (Ck=0). Subsequently, the process from step S13 is repeated and the temperature differences Tpp are calculated, the differential ΔTpp is calculated for each pair of thermopiles that has been set in advance, and the comparison between each of all the calculated differences ΔTpp and the threshold Th is performed.

In this repetitive process, when it is judged that the differential. ΔTpp calculated based on the temperatures measured by a pair of thermopiles is equal to or greater than the threshold Th (Yes in step S18), a count number Ck of the abnormality counter is incremented by one (step S19). Following this, it is judged whether or not the count number Ck of the abnormality counter has reached a predetermined number Cc that has been set in advance (step S20).

When it is judged that the count number Ck of the abnormality counter has not reached the predetermined number Cc (for example, three) (No in step S20), the control returns to step S13 because it is determined that there is a possibility that there has been made an erroneous judgment that an abnormality has occurred in the resistance heating layer 31*b* of the heating belt 31, due to the temperatures measured by the thermopiles having been affected by noise or the like. The process from step S13 is repeated. The process of steps S13-S20 is repeated until the count number Ck of the abnormality counter reaches the predetermined number Cc.

Subsequently, when, in step S18, it is judged in succession for a predetermined number (Cc) of times that the differential ΔTpp calculated based on the temperatures measured by a pair of thermopiles is equal to or greater than the threshold Th, and it is judged that the count number Ck of the abnormality counter has reached the predetermined number Cc (Yes in step S20), it is judged that an abnormality has occurred in the resistance heating layer 31*b* of the heating belt 31, and that the temperature measurement, which is the basis of the judgment, has been conducted normally by the thermopiles without being affected by noise or the like.

When this judgment is made, a notification that an abnormality has occurred is displayed on a display unit 28 provided in the operation panel (step S21). In that case, a notification that the print operation needs to be prohibited may be displayed together with the above notification. With this operation, the abnormality judgment control ends.

Note that, when it is judged that an abnormality has occurred, the position of the measurement region Px (in the width direction of the heating belt 31) which is considered to have the abnormality may be displayed on the display unit 28. Also, when it is judged that a plurality of abnormalities have occurred in a plurality of regions, a notification that a plurality of abnormalities have occurred may be displayed. Furthermore, in that case, respective positions of in the width direction of the heating belt 31 which are considered to have the abnormalities may be displayed on the display unit 28 together with the notification.

During the repetition of the process from step S13, when it is detected that all of the differences ΔTpp calculated based on the temperature differences Tpp of the temperatures measured by all combinations of thermopiles are smaller than the threshold Th (No in step S18) before the judgment that the differential ΔTpp calculated based on the temperatures measured by a pair of thermopiles is equal to or greater than the threshold Th is made continuously for a predetermined number of times (three times), the control returns to step S12, the abnormality counter is reset to the initial state (Ck=0), and then the process from step S13 is repeated.

Also, during the repetition of the process from step S13, when it is detected that the temperature adjustment control has not been performed on the resistance heating layer 31*b* of the heating belt 31 (No in step S13), it is determined that the print job is completed, and the abnormality judgment control ends.

As described above, in the present embodiment, when a print job is executed and the recording sheet S is transported center-based, the temperature difference Tpp between the maximum value Tmax and the minimum value Tmin is calculated for each pair of thermopiles that measure the temperatures, the combination of thermopiles having been set in advance, the differential ΔTpp between temperature differences Tpp of the thermopiles in each pair is calculated, and based on the calculated value of the differential ΔTpp, it is judged whether or not an abnormality such as a scratch has occurred in the resistance heating layer 31*b* of the heating belt 31.

With the above structure, the measurement regions Px measured by the thermopiles set as a pair in advance are both included in the paper-passing region or the non-paper-passing region. Therefore if the amount of change in temperature in the paper-passing region varies due to a continuous transportation of the recording sheet, the influence by the amount of temperature change is cancelled, and thus it is possible to detect an occurrence of an abnormality in the resistance heating layer 31*b* with high accuracy.

Also, if the amount of change in temperature in the measurement regions Px varies due to non-uniformity of the resistance heating layer in thickness in the circumferential direction, the influence by the amount of change in temperature is cancelled. This also allows for detection of an occurrence of an abnormality in the resistance heating layer 31*b* with high accuracy.

Furthermore, thermopiles of each pair are combined such that the two measurement regions Px measured by the thermopiles are not adjacent to each other in the width direction of the heating belt 31. Therefore, if an abnormality such as a scratch has occurred in one of the measurement regions Px of a pair in the resistance heating layer 31*b*, the other measurement region Px of the pair is not affected by a temperature change that would occur due to the presence of the scratch. This makes it possible to detect an occurrence of an abnormality such as a scratch in the resistance heating layer 31*b* with high accuracy.

Also note that, in the present embodiment, the temperature of the whole resistance heating layer 31*b* increases after the heating belt 31 starts to be heated as the resistance heating layer 31*b* receives supply of power. Thus, it is possible to detect an occurrence of an abnormality in the resistance heating layer 31*b* based on the amount of temperature change during the increase of the temperature. Accordingly, it is possible to detect an occurrence of an abnormality in the resistance heating layer 31*b* even during the warming-up before the heating belt 31 reaches the fixing temperature.

[Embodiment 2]

In the present embodiment, the recording sheet S is transported and passes through the fixing nip by a one-sided transportation where the recording sheet S is transported such that one side of the recording sheet S, which is at one end in a direction perpendicular to the transportation direction, aligns with one side of the transportation path which is at one end thereof in the width direction, instead of the center-based transportation.

In the present embodiment, the temperature differences Tpp are also obtained based on the temperatures measured by all the thermopiles of the first temperature sensor 51 and the second temperature sensor 52, and the comparison of the obtained temperature differences Tpp is performed for each pair of thermopiles that has been set in advance. In the present embodiment too, thermopiles of each pair, which are combined for the comparison of temperature differences Tpp, are combined such that the two measurement regions Px measured by the thermopiles are not adjacent to each other, and such that the measurement regions Px measured by the thermopiles of a pair are both included in the paper-passing region or the non-paper-passing region.

Figure 12:
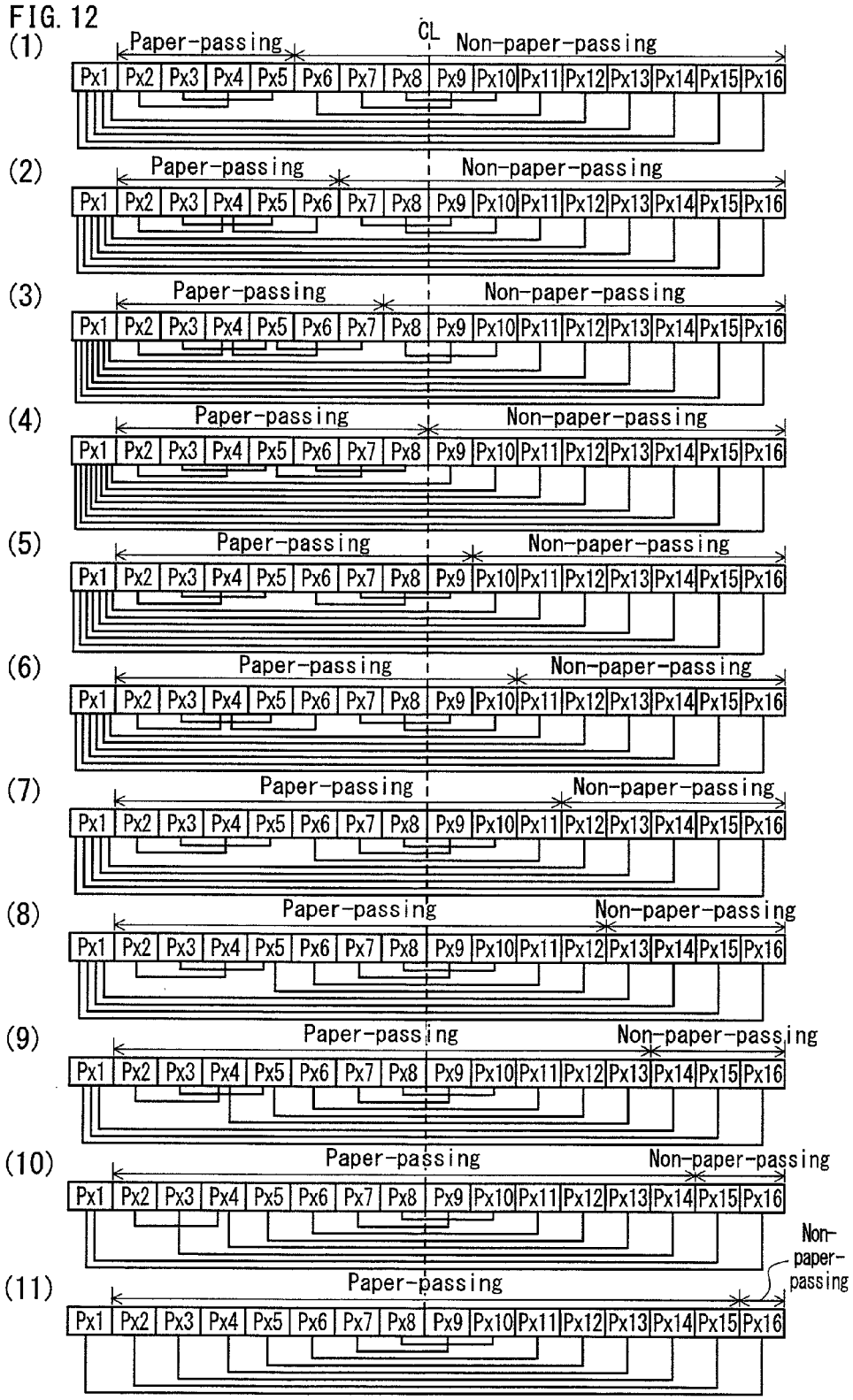
FIG. 12 is a schematic diagram illustrating the combinations of the measurement regions corresponding to the combinations of thermopiles of each pair between which the comparison of the difference between the maximum value and the minimum value of the measured temperatures is performed, when the recording sheet is transported by the one-sided transportation.

FIG. 12 is a schematic diagram illustrating the combinations of the measurement regions corresponding to the combinations of thermopiles of each pair between which the comparison of the difference Tpp between the maximum value and the minimum value of the measured temperatures is performed, when the recording sheet S is transported by the one-sided transportation. FIG. 13 is a table showing the combinations of measurement regions Px illustrated in FIG. 12.

Note that in the present embodiment, eight measurement regions Px respectively measured by eight thermopiles of the first temperature sensor 51 are identified as follows: a measurement region Px located at one end of the heating belt 31 in the width direction is identified as a first measurement region Px1 (corresponding to the eighth measurement region PxA8 in Embodiment 1); and seven measurement regions Px disposed in sequence from the next to the first measurement region Px1 to the center of the heating belt 31 in the width direction are identified as second to eighth measurement regions Px2 to Px8 (corresponding to the seventh to first measurement regions PxA7 to PxA1 in Embodiment 1).

Also, eight measurement regions Px respectively measured by eight thermopiles of the second temperature sensor 52 are identified as follows: a measurement region Px located at the center of the heating belt 31 in the width direction and adjacent to the eighth measurement region Px8 measured by the first temperature sensor 51 is identified as a ninth measurement region Px9 (corresponding to the first measurement region PxB1 in Embodiment 1); and seven measurement regions Px disposed in sequence from the next to the ninth measurement region Px9 to the other end of the heating belt 31 in the width direction are identified as $10^{th}$ to $16^{th}$ measurement regions Px10 to Px16 (corresponding to the second to eighth measurement regions PxB2 to PxB8 in Embodiment 1).

Note that, among all the measurement regions Px, the first measurement region Px1 and the $16^{th}$ measurement region Px16 located at both ends of the heating belt 31 correspond to the electrode parts 31*g* against which the electricity supplying members 37 are pressed, and thus both measurement regions Px1 and Px16 are always included in the non-paper-passing region regardless of the size of the transported recording sheet S.

The recording sheet S is transported by the one-sided transportation such that one side of the recording sheet S which is at one end in a direction perpendicular to the transportation direction is always at the boundary between the first measurement region Px1 and the second measurement region Px2. For this reason, the number of measurement regions Px included in the non-paper-passing region in the fixing nip N varies depending on a length d mm of the recording sheet S (corresponding to the paper-passing region) in a direction perpendicular to the transportation direction of the recording sheet S.

When a recording sheet S of the smallest size (d=90) is transported (the case (1) in FIG. 12), the second to fifth measurement regions Px2 to Px5 are included in the paper-passing region. In this case, suppose that the sixth measurement region Px6 is included in the non-paper-passing region since it includes only a part of the paper-passing region, then the sixth to $16^{th}$ measurement regions Px6 to Px16 are included in the non-paper-passing region. As a result, the second measurement region Px2 and the fourth measurement region Px4 are combined as a pair and the third measurement region Px3 and the fifth measurement region Px5 are combined as a pair so that measurement regions selected as a pair from the second to fifth measurement regions Px2 to Px5 that are included in the paper-passing region are not adjacent to each other.

Each pair of measurement regions is selected from the sixth to $16^{th}$ measurement regions Px6 to Px16, which are included in the non-paper-passing region, such that the measurement regions of each pair are not adjacent to each other, and the measurement regions Px of each pair are either located symmetrical with each other with respect to the center line CL (the boundary between the eighth measurement region Px8 and the ninth measurement region Px9) that extends passing the center of the width of the heating belt 31, or adjacent to the measurement regions Px that are located symmetrical with each other.

Accordingly, the sixth measurement region Px6 and the $11^{th}$ measurement region Px11 are combined to make a pair, the seventh measurement region Px7 and the ninth measurement region Px9 are combined to make a pair, and the eighth measurement region Px8 and the $10^{th}$ measurement region Px10 are combined to make a pair, and each of the $12^{th}$ to $16^{th}$ measurement regions Px12 to Px16 is combined with the first measurement region Px1.

Note that when the length d mm (the length of the paper-passing region) of the transported recording sheet S is larger than the length of the smallest size of the recording sheet S and equal to or smaller than the sequential length of the second to fifth measurement regions Px2 to Px5 (90 mm 104 mm) (hereinafter the range is referred to as "first range"), the same combinations of measurement regions as those in the case where a recording sheet S of the smallest size (d=90) is transported are applied.

When the length d mm (the length of the paper-passing region) of the transported recording sheet S is larger than the first range and equal to or smaller than the sequential length of the second to sixth measurement regions Px2 to Px6 (104 mm<d≤126 mm) (hereinafter the range is referred to as "second range"), the sixth measurement region Px6, which is included in the paper-passing region, is combined with the fourth measurement region Px4. In connection with this, the fourth measurement region Px4 is combined with the sixth measurement region Px6 and with the second measurement region Px2. Also, the $11^{th}$ measurement region Px11, which is included in the non-paper-passing region, is combined with the first measurement region Px1. The other combinations for the second range are the same as those for the first range.

When the length d mm (the length of the paper-passing region) of the transported recording sheet S is larger than the second range and equal to or smaller than the sequential length of the second to seventh measurement regions Px2 to Px7 (126 mm<d≤152 mm) (hereinafter the range is referred to as "third range"), the seventh measurement region Px7, which is included in the paper-passing region, is combined with the fifth measurement region Px5. As a result, the fifth measurement region Px5 is combined with the seventh measurement region Px7 and with the third measurement region Px3. Also, the ninth measurement region Px9, which is included in the non-paper-passing region, is combined with the first measurement region Px1. The other combinations for the third range are the same as those for the second range.

When the length d mm (the length of the paper-passing region) of the transported recording sheet S is larger than the third range and equal to or smaller than the sequential length of the second to eighth measurement regions Px2 to Px8 (152 mm<d≤178 mm) (hereinafter the range is referred to as "fourth range"), the eighth measurement region Px8, which is included in the paper-passing region, is combined with the sixth measurement region Px6. Also, the combination of the second measurement region Px2 and the sixth measurement region Px6 is deleted. Furthermore, the $10^{th}$ measurement region Px10, which is included in the non-paper-passing region, is combined with the first measurement region Px1. The other combinations for the fourth range are the same as those for the third range.

When the length d mm (the length of the paper-passing region) of the transported recording sheet S is larger than the fourth range and equal to or smaller than the sequential length of the second to ninth measurement regions Px2 to Px9 (178 mm<d≤204 mm) (hereinafter the range is referred to as "fifth range"), the ninth measurement region Px9, which is included in the paper-passing region, is combined with the seventh measurement region Px7. Also, the combination of the fifth measurement region Px5 and the seventh measurement region Px7 is deleted. The other combinations for the fifth range are the same as those for the fourth range.

When the length d mm (the length of the paper-passing region) of the transported recording sheet S is larger than the fifth range and equal to or smaller than the sequential length of the second to tenth measurement regions Px2 to Px10 (204 mm<d≤226 mm) (hereinafter the range is referred to as "sixth range"), the tenth measurement region Px10, which is included in the paper-passing region, is combined with the eighth measurement region Px8, and the sixth measurement region Px6 is combined with the fourth measurement region Px4. In connection with this, the fourth measurement region Px4 is combined with the sixth measurement region Px6 and with the second measurement region Px2. The other combinations for the sixth range are the same as those for the fifth range.

When the length d mm (the length of the paper-passing region) of the transported recording sheet S is larger than the sixth range and equal to or smaller than the sequential length of the second to $11^{th}$ measurement regions Px2 to Px11 (226 mm<d≤247 mm) (hereinafter the range is referred to as "seventh range"), the $11^{th}$ measurement region Px1*l*, which is included in the paper-passing region, is combined with the sixth measurement region Px6. Also, the combination of the sixth measurement region Px6 and the fourth measurement region Px4 is deleted. The other combinations for the seventh range are the same as those for the sixth range.

When the length d mm (the length of the paper-passing region) of the transported recording sheet S is larger than the seventh range and equal to or smaller than the sequential length of the second to $12^{th}$ measurement regions Px2 to Px12 (247 mm<d≤267 mm) (hereinafter the range is referred to as "eighth range"), the 12th measurement region Px12, which is included in the paper-passing region, is combined with the fifth measurement region Px5. Also, the fifth measurement region Px5 is combined with the third measurement region Px3 and with the $12^{th}$ measurement region Px12. The other combinations for the eighth range are the same as those for the seventh range.

When the length d mm (the length of the paper-passing region) of the transported recording sheet S is larger than the eighth range and equal to or smaller than the sequential length of the second to $13^{th}$ measurement regions Px2 to Px13 (267 mm<d≤287 mm) (hereinafter the range is referred to as "ninth range"), the $13^{th}$ measurement region Px13, which is included in the paper-passing region, is combined with the fourth measurement region Px4. Also, the fourth measurement region Px4 is combined with the second measurement region Px2 and with the $13^{th}$ measurement region Px13. The other combinations for the ninth range are the same as those for the eighth range.

When the length d mm (the length of the paper-passing region) of the transported recording sheet S is larger than the ninth range and equal to or smaller than the sequential length of the second to $14^{th}$ measurement regions Px2 to Px14 (287 mm<d≤309 mm) (hereinafter the range is referred to as "tenth range"), the $14^{th}$ measurement region Px14, which is included in the paper-passing region, is combined with the third measurement region Px3. Also, the combination of the third measurement region Px3 and the fifth measurement region Px5 is deleted. The other combinations for the tenth range are the same as those for the ninth range.

When the length d mm (the length of the paper-passing region) of the transported recording sheet S is larger than the tenth range and equal to or smaller than the sequential length of the second to $15^{th}$ measurement regions Px2 to Px15 (309 mm<d≤330 mm) (hereinafter the range is referred to as "eleventh range"), the $15^{th}$ measurement region Px15, which is included in the paper-passing region, is combined with the second measurement region Px2. Also, the combination of the second measurement region Px2 and the fourth measurement region Px4 is deleted. The other combinations for the eleventh range are the same as those for the tenth range.

As described above, combinations of pairs of thermopiles, for each of which the comparison of the difference Tpp between the maximum value and the minimum value of the measured temperatures is performed, are set based on the length d mm of the recording sheet S in the direction perpendicular to the transportation direction of the recording sheet S, and are stored in the control unit 60.

Also, in the present embodiment, the sheet size sensor 41 (see FIG. 5) is provided to detect the size of the transported recording sheet S. This is because combinations of pairs of thermopiles are changed depending on the length d mm of the recording sheet S in the direction perpendicular to the transportation direction of the recording sheet S. The sheet size sensor 41 is, for example, composed of a line sensor that detects a length of the recording sheet S along the direction perpendicular to the transport direction of the recording sheet S transported by the one-sided transportation.

Note that the structure of the sheet size sensor 41 is not limited to this. For example, the sheet size sensor 41 may be provided in the paper feed cassette 22 so that it detects the length of the recording sheet along the direction perpendicular to the transport direction of the recording sheet, by contacting a side of the recording sheet housed in the paper feed cassette.

As another example, the sheet size sensor 41 may not be provided. Instead, an input unit may be provided in the operation panel so that the user can input the size of the recording sheet S via the input unit, and the length of the recording sheet S along the direction perpendicular to the transportation direction of the recording sheet S may be detected based on the information input via the input unit.

The operation of the present embodiment is the same as that of the previous embodiment in which the recording sheet is transported by the center-based transportation, except for the combinations of pairs of thermopiles, for each of which the comparison of the temperature difference Tpp between the maximum value and the minimum value of the measured temperatures is performed. Thus, in the flowchart illustrated in FIG. 11, step S14 in which the timer is started to measure an elapse time is followed by a process of detecting the length d mm of the recording sheet S along the direction perpendicular to the transportation direction of the recording sheet S, and a process of determining, based on the detected length d mm, each pair of thermopiles between which the comparison of the temperature difference Tpp between the maximum value and the minimum value of the measured temperatures is performed.

After these processes, the process from step S16 in the flowchart illustrated in FIG. 11 is executed.

Accordingly, the present embodiment also makes it possible to detect an occurrence of an abnormality such as a scratch in the resistance heating layer 31*b* with high accuracy, by detecting whether or not an abnormality such as a scratch has occurred in the resistance heating layer 31*b* by performing the comparison of the temperature difference Tpp between the maximum value and the minimum value of the measured temperatures, between thermopiles of each pair which have been combined such that the two measurement regions Px measured by the thermopiles are not adjacent to each other and are both included in the paper-passing region or the non-paper-passing region.

[Modifications]

In the above embodiments, the temperatures measured by all thermopiles of the first temperature sensor 51 and the second temperature sensor 52 are sampled at predetermined sampling timings, the temperature difference Tpp between the maximum value Tmax and the minimum value Tmin is calculated for each thermopile, and the temperature difference Tpp is compared between two thermopiles of each pair whose combination has been set in advance. However, not limited to this structure, for example, the maximum value Tmax or an average value of the temperatures measured by each thermopile may be obtained, and the obtained maximum value Tmax or average value may be compared between two thermopiles of each pair whose combination has been set in advance.

In the above embodiments, a printer in which the recording sheet S is transported by the center-based transportation and a printer in which the recording sheet S is transported by the one-sided transportation are described. However, not limited to this, the present invention can be applied to a printer that supports switching between the center-based transportation and the one-sided transportation of the recording sheet S. In the case of the above printer, the printer first detects by which of the center-based transportation and the one-sided transportation the recording sheet S is transported, executes the abnormality judgment control described in Embodiment 1 when the recording sheet S is transported by the center-based transportation, and executes the abnormality judgment control described in Embodiment 2 when the recording sheet S is transported by the one-sided transportation.

In the above embodiments, the fixing roller 33 and the heating belt 31 are separately provided, and the fixing roller 33 is provided within the range of circulating movement of the heating belt 31. However, not limited to this structure, the fixing roller 33 and the resistance heating layer 31*b* may be formed as one unit to be a heating rotating body, with the resistance heating layer 31*b* located on the outer circumferential surface of the fixing roller 33.

In the above embodiments, the pressing roller 32 as a pressing unit is pressed against the heating belt 31 to form the fixing nip N. However, the pressing unit for forming the fixing nip N is not limited to the pressing roller 32, but, for example, a belt may be used. Furthermore, the pressing unit does not need to rotate like the pressing roller 32 or the belt, thus it may be a fixed pressing member or the like.

In the above embodiments, a commercial alternating-current power source is used as the power source of the fixing device 30. However, not limited to this, a direct-current power source may be used.

The image forming apparatus of the present invention is not limited to a tandem-type color printer, but may be a printer for forming monochrome images. Also, the image forming apparatus is not limited to a printer, but may be a copier, an MFP (Multiple Function Peripheral), a fax machine or the like that can form color or monochrome images.

<Summary of embodiments>

In the image forming apparatus of the present invention, for example, when a plurality of recording sheets pass through the fixing nip continuously, the recording sheets remove heat from the heating rotating body during one rotational period, thereby creating a great temperature change in the measurement regions of the paper-passing region, and thus varying the obtained information. In that case, the same temperature change occurs in both measurement regions (belonging to the paper-passing region) between which the comparison is made, and the obtained pieces of information vary in the same manner. Accordingly, with the structure of the image forming apparatus of the present invention, when an abnormality has occurred in either of the measurement regions, it is possible to judge accurately that the abnormality has occurred in the resistance heating layer, without being affected by the temperature change that occurs in the paper-passing region.

Similarly, with regard to the non-paper-passing region in the image forming apparatus of the present invention, the same temperature change occurs in both measurement regions (belonging to the non-paper-passing region) between which the comparison of the information indicating temperature changes in the measurement regions belonging to the non-paper-passing region is made, and the obtained pieces of information vary in the same manner, and accordingly, when an abnormality has occurred in either of the measurement regions, it is possible to judge accurately that the abnormality has occurred in the resistance heating layer, without being affected by the temperature change that occurs in the non-paper-passing region.

In the above image forming apparatus, each combination of measurement regions may be a pair of measurement regions.

In the above image forming apparatus, each combination of measurement regions may be a combination of measurement regions that are not adjacent to each other.

In the above image forming apparatus, the recording sheet may be transported with reference to a center of a width of a sheet transportation path, and the two measurement regions in each combination of measurement regions are symmetrical with respect to the center of the width of the sheet transportation path in the nip.

In the above image forming apparatus, the recording sheet may be transported with reference to one side of a sheet transportation path, and the two measurement regions in each combination are set in accordance with a length of the recording sheet along a direction perpendicular to a transportation direction of the recording sheet.

In the above image forming apparatus, a minimum size of the recording sheet passing through the nip may be set in advance, and four or more measurement regions are assigned to the paper-passing region in the nip for a case where the recording sheet of the minimum size passes through the nip.

In the above image forming apparatus, the information obtaining unit may obtain, as the information, a temperature difference between a maximum temperature and a minimum temperature in each of the temperature changes in the measurement regions.

In the above image forming apparatus, the abnormality judging unit may calculate a differential between temperature differences for each combination of measurement regions, and judges that an abnormality has occurred in one of measurement regions in a combination when a differential between temperature differences of the measurement regions in the combination is greater than a predetermined threshold.

The present invention is useful as a technology for, during the print operation, detecting accurately whether or not an abnormality has occurred in the resistance heating layer that emits heat when electric current flows through it.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image foaming apparatus comprising:

a fixing device configured to thermally fix an unfixed image on a recording sheet by causing the recording sheet with the unfixed image formed thereon to pass through a nip formed by a pressing against an outer circumferential surface of all heating rotating body that has a resistance heating layer;

a temperature measuring unit configured to measure temperatures of the resistance heating layer in a plurality of measurement that are set by sectioning the outer circumferential surface of the heating rotating body along a rotational axis direction of the heating rotating body;

an information obtaining unit configured to obtain information indicating temperature changes in the measurement regions in one rotational period of the heating rotating body, by sampling the temperatures measured by the temperature measuring unit during rotation of the heating rotating body; and an abnormality judging unit configured to judge whether or not an abnormality has occurred in the resistance heating layer in accordance with a result of comparison of the information obtained by the information obtaining unit, the comparison being made between measurement re ions in each combination of measurement re ions in a state where one or more combinations of measurement regions have been set by using all measurement regions of a paper-passing region in the nip and one or more combinations of measurement regions have been set by using all measurement regions of a non-paper-passing region in the nip, wherein each combination of measurement regions is a pair of measurement regions, and wherein the recording sheet is transported with reference to a center of a width of a sheet transportation path, and the two measurement regions in each combination of measurement regions are symmetrical with respect to the center of the width of the sheet transportation path in the nip.

2. The image forming apparatus of claim 1, wherein each combination of measurement regions is a combination of measurement regions that are not adjacent to each other.

3. The image forming apparatus of claim 1, wherein the information obtaining unit obtains, as the information, a temperature difference between a maximum temperature and a minimum temperature in each of the temperature changes in the measurement regions.

4. The image forming apparatus of claim 1, wherein the abnormality judging unit calculates a differential between temperature differences for each combination of measurement regions, and judges that an abnormality has occurred in one of measurement regions in a combination when a differential between temperature differences of the measurement regions in the combination is greater than a predetermined threshold.

5. An image foaming apparatus comprising:

a fxing device configured to unfixed image on a recording sheet by causing the recording sheet with the unfixed thereon to pass through a nip formed by a pressing member pressing against an outer circumferential surface of a heating rotating body that has a resistance heating layer;

a temperature measuring unit configured to measure temperatures of the resistance heating layer in a plurality of measurement regions that are set by sectioning the outer circumferential surface of the heating rotating body along a rotational axis direction of the heating rotating body;

an information obtaining unit configured to obtain information indicating temperature changes in the measurement regions in one rotational period of the heating rotating body, by sampling the temperatures measured by the temperature measuring unit during rotation of the heating body; and an abnormality judging unit configured to judge whether or not an abnormality has occurred in the resistance heating layer in accordance with a result of comparison of the information obtained by the information obtaining unit, the comparison being made between measurement regions in each combination of measurement regions in a state where one or more combinations of measurement regions have been set by using all measurement regions of a paper-passing region in the nip and one or more combination measurement regions have been set by using all measurement regions of a non-paper-passing region in the nip, wherein each combination of measurement regions is a pair of measurement regions, and wherein the recording sheet is transported with reference to one side of a sheet transportation path, and the two measurement regions in each combination are set in accordance with a length of the recording sheet along a direction perpendicular to a transportation direction of the recording sheet.

6. The image forming apparatus of claim 5, wherein each combination of measurement regions is a combination of measurement regions that are not adjacent to each other.

7. The image forming apparatus of claim 5, wherein the information obtaining unit obtains, as the information, a temperature difference between a maximum temperature and a minimum temperature in each of the temperature changes in the measurement regions.

8. The image forming apparatus of claim 5, wherein the abnormality judging unit calculates a differential between temperature differences for each combination of measurement regions, and judges that an abnormality has occurred in one of measurement regions in a combination when a differential between temperature differences of the measurement regions in the combination is greater than a predetermined threshold.

9. An image foaming apparatus of comprising:

a fixing device configured to thermally fix an unfixed image on a recording sheet by causinf the recording sheet with the unfixed image formed thereon to pass through a nip formed by a presing member presing agnist an outer circumferential surface of a heating rotating body that has a resistance heating layer;

a temperature measuring unit configured to measure temperatures of resistance heatin layer in a plurality of measurement regions that ere set by sectioning the outer circumferential surface of the heating rotating body along a rotational axis direction of the heating rotating body;

an information obtaining configured to obtain information indicating temperature changes in the measurement regions in one rotational period of the heating rotating body, by sampling the temperatures measured by the temperature measuring the unit during rotation of the heating rotating body; and an abnormality judging unit configured to judge whether or not an abnormality has occurred in the resistance heating layer in accordance with a result of comparison of the information obtained by the information obtaining unit, the comparison being made between measurement regions in each combination of measurement regions in a state where one or more combinations of a measurement regions have been set by all measurement regions of a paper-passing region in the nip and one or more combinations of measurement regions have been set by using all measurement regions of a non-paper-passing region in the nip, wherein each combination of measurement regions is a pair of measurement regions, and wherein a minimum size of the recording sheet passing through the nip is set in advance, and four or more measurement regions are assigned to the paper-passing region in the nip for a case where the recording sheet of the minimum size passes through the nip.

10. The image forming apparatus of claim 9, wherein each combination of measurement regions is a combination of measurement regions that are not adjacent to each other.

11. The image forming apparatus of claim 9, wherein the information obtaining unit obtains, as the information, a temperature difference between a maximum temperature and a minimum temperature in each of the temperature changes in the measurement regions.

12. The image forming apparatus of claim 9, wherein the abnormality judging unit calculates a differential between temperature differences for each combination of measurement regions, and judges that an abnormality has occurred in one of measurement regions in a combination when a differential between temperature differences of the measurement regions in the combination is greater than a predetermined threshold.

* * * * *